US007100657B2

(12) United States Patent
Kataoka et al.

(10) Patent No.: US 7,100,657 B2
(45) Date of Patent: Sep. 5, 2006

(54) SHEET SLITTER-WINDER

(75) Inventors: Hiroshi Kataoka, Iyomishima (JP); You Kataoka, Iyomishima (JP)

(73) Assignee: Kataoka Machine Co., Ltd., Iyomishima (JP)

( * ) Notice: Subject to any disclaimer, the term of this patent is extended or adjusted under 35 U.S.C. 154(b) by 417 days.

(21) Appl. No.: 10/359,248

(22) Filed: Feb. 6, 2003

(65) Prior Publication Data

US 2003/0150546 A1 Aug. 14, 2003

(30) Foreign Application Priority Data

| | | |
|---|---|---|
| Feb. 6, 2002 | (JP) | 2002-028997 |
| Mar. 15, 2002 | (JP) | 2002-073147 |
| May 20, 2002 | (JP) | 2002-143975 |
| Aug. 26, 2002 | (JP) | 2002-245642 |

(51) Int. Cl.
*B65H 18/00* (2006.01)

(52) U.S. Cl. ..... 156/457; 156/458; 156/510; 156/565; 118/257; 242/522; 242/527; 242/532.3; 242/530.1; 242/525.1; 242/525.2; 242/527.3

(58) Field of Classification Search ..... 156/510, 156/443, 425, 446, 565, 573, 457, 458; 242/522, 242/523.1, 532.3, 525.1, 525.2, 532.1, 527, 242/541.4, 547, 548, 532, 530, 523, 530.1; 118/257, 258; 11/257
See application file for complete search history.

(56) References Cited

U.S. PATENT DOCUMENTS

| | | | | |
|---|---|---|---|---|
| 3,610,545 | A * | 10/1971 | Reifenhauser et al. | 242/527.3 |
| 3,779,475 | A * | 12/1973 | Plevin | 242/530.4 |
| 3,784,122 | A * | 1/1974 | Kataoka | 242/525.7 |
| 3,919,970 | A * | 11/1975 | Spielvogel | 118/203 |
| 4,422,588 | A * | 12/1983 | Nowisch | 242/524.1 |
| 4,775,110 | A * | 10/1988 | Welp et al. | 242/521 |
| 4,789,109 | A * | 12/1988 | Kyytsonen et al. | 242/527 |
| 5,310,130 | A * | 5/1994 | Wieland et al. | 242/527 |
| 5,409,534 | A * | 4/1995 | Kustermann | 118/201 |
| 5,478,026 | A * | 12/1995 | Schonmeier et al. | 242/527.2 |
| 5,735,481 | A * | 4/1998 | Loosen | 242/526.1 |
| 6,241,178 | B1 * | 6/2001 | Schonmeier et al. | 242/541.5 |
| 6,805,317 | B1 * | 10/2004 | Andersson et al. | 242/532.3 |

FOREIGN PATENT DOCUMENTS

| | | |
|---|---|---|
| JP | 52-62784 | 5/1977 |
| JP | 63-26053 | 5/1988 |
| JP | 1-16639 | 3/1989 |
| JP | 7-80597 | 8/1995 |
| JP | 2554803 | 11/1997 |
| JP | 2001-341905 | 12/2001 |
| WO | WO 9961360 A1 * | 12/1999 |

* cited by examiner

*Primary Examiner*—Richard Crispino
*Assistant Examiner*—Chris Schatz
(74) *Attorney, Agent, or Firm*—Oblon, Spivak, McClelland, Maier & Neustadt, P.C.

(57) ABSTRACT

A sheet slitter winder that uses a sheet slitter to slit a wide sheet into a plurality of sheets of predetermined width, and winders to wind the slit sheets onto winding cores. Touch rollers contact the winding rolls. Temporary sheet-holding means have a sheet-retaining plate that can be contacted with and separated from the touch rollers and can temporarily hold a slit sheet against an outside peripheral surface of a touch roller at a point upstream of a point of contact between a touch roller and a roll. Cutting means are used to cut widthwise across the slit sheets thus held in place.

11 Claims, 24 Drawing Sheets

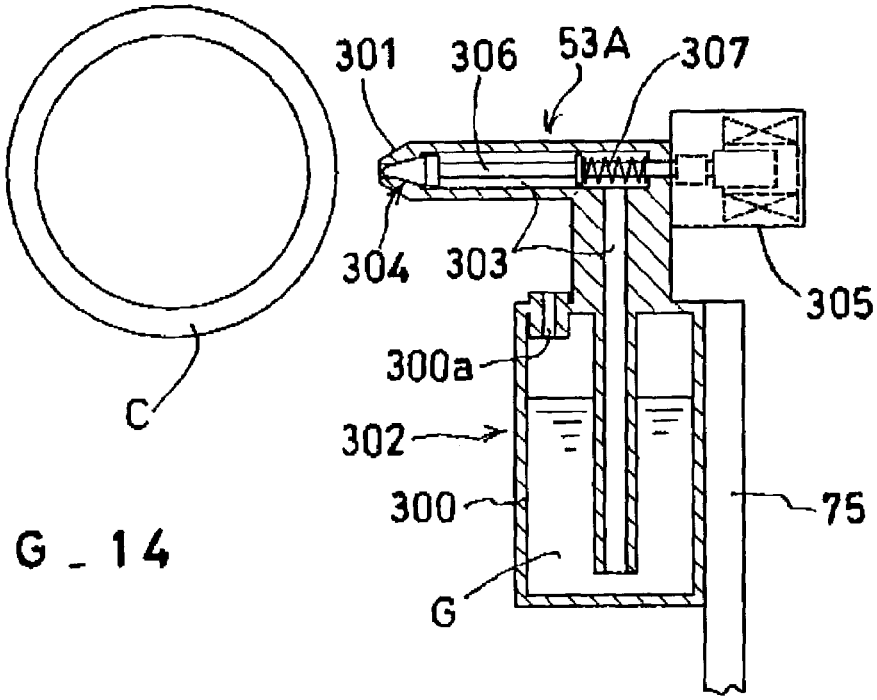
FIG_14
FIG_15
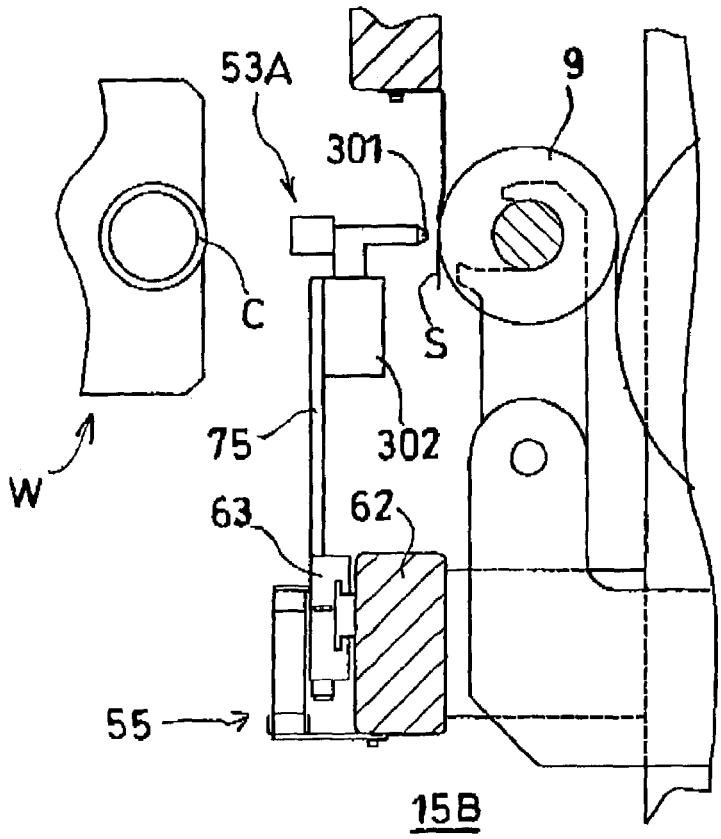

SHEET SLITTER-WINDER

BACKGROUND OF THE INVENTION

1. Field of the Invention

The present invention relates to an improved sheet slitter-winder that slits a wide sheet of plastic film or paper or the like into a plurality of sheets of a predetermined width and winds each sheet on a core, that shortens the time required between the stopping of the winding when the winding of a sheet is completed and the start of the next winding operation. It particularly relates to a sheet slitter-winder in which the winder that winds the slit sheet includes touch rollers that guide the slit sheet to the rotating core of the winder and are in contact wilt the peripheral surface of the sheet roll formed by the sheet being thus wound around the core.

2. Description of the Prior Art

In a conventional sheet slitter-winder, when the winding of a predetermined amount of the sheet is completed, the winding drive is stopped, a space is opened between the wound roll and the touch rollers and the sheet leading to the roll is cut on the downstream side of the touch rollers. The wound roll is then removed from the roll holder and replaced by a new core, the sheet is gripped between the new core and the touch rollers, an operator uses adhesive tape or the like to stick the leading edge of the sheet to the core, and winding is resumed.

In the winding apparatus disclosed by JP-B HEI 7-80597, when the sheet attached to a wound roll is cut, to prevent the end of the slit sheet being drawn free of the touch rollers and falling, a support frame is provided to hold the sheet. The frame is at a set distance in the normal direction from the point of contact between the touch rollers and the roll and slightly toward the roll, and extends in the width direction of the sheet On the opposite side of the support frame to where the slit sheet is held, a prop frame is provided that extends in the width direction of the sheet and can be moved from a standby position to push a slit sheet toward the support frame. In order to cut widthwise across the slit sheets just downstream of the support frame, there is a blade that can be moved along the support frame. Double-sided adhesive tape is adhered to the surface of the support frame against which the slit sheet is pushed by the prop frame. When the slit sheet attached to the roll is to be cut, it is pushed toward the support frame by the prop frame and the blade is moved to cut the sheet. After the slit sheet is thus cut, the end of the slit sheet on the upstream side is supported by its adhesion to the support frame.

However, the support frame has to be located far enough away from the touch rollers and roll to ensure that the frame does not interfere with the winding operation. This results in the distance between the support frame and the point of contact being quite large. Since the slit sheet is cut along the support frame, the length of the sheet from the touch rollers to the cut point is too long. Moreover, when the slit sheet is placed between the winding core and the touch rollers and the leading edge of the slit sheet is affixed to the core to resume winding, the operator either trims away the excess part of the sheet on the upstream side or, after adhering the end of the slit sheet to the core, slightly separates the core from the touch rollers and rotates it to wind the excess part of the slit sheet onto the core. This is time-consuming and lowers the rate of operation of the winder.

In the invention described by JP-B SHO 63-26053, the touch rollers have a suction mechanism for processing the trailing end of the wound sheet. When the slit sheet is cut across its width by the cutter, the slit sheet on the upstream side is held on the touch rollers by the suction mechanism, enabling the trailing end of the sheet to be efficiently processed. However, the touch rollers have to be hollow to accommodate the suction means, and have to be provided with many suction holes on the peripheral surface that can damage or deform the slit sheets traveling at high speed.

The present invention was accomplished in view of the above, and has as its object to provide a sheet slitter-winder that has a high operating ratio attained by reducing the time and work required to cut a slit sheet attached to a completed roll and adhere the cut end of the sheet on the upstream side to a new core.

Another object is to provide a sheet slitter-winder that attains high productivity by applying adhesive to a core or slit sheet and reducing the time and work required to apply the adhesive.

Another object is to provide a sheet slitter-winder that attains high productivity by reducing the time and work to mount a new core on the core chucks.

SUMMARY OF THE INVENTION

To attain the above object, the invention provides a sheet slitter-winder, comprising a sheet slitter that slits a wide sheet into a plurality of sheets of predetermined width; winders that wind the sheets slit by the slitter onto winding cores to form rolls, and each have touch rollers that contact the rolls; temporary sheet-holding means each having a sheet-retaining plate that can be contacted with and separated from a touch roller and enabling a front edge of the sheet-retaining plate to temporarily hold a slit sheet against an outside peripheral surface of a touch roller at a point upstream of a point of contact between each touch roller and each roll; and cutting means that can cut widthwise across the slit sheet held against the touch roller by the front edge of the sheet-retaining plate, downstream from the point of contact between each touch roller and each roll.

The invention also provides a sheet slitter-winder, comprising a sheet slitter that slits a wide sheet into a plurality of sheets of predetermined width; first and second winders which wind the sheets slit by the slitter onto rotating winding cores to form rolls and between which winding of the slit sheets is alternated, each winder comprising a winding base, a pair of winding arms provided for a core and mounted on the winding base, a pair of core chucks provided for the pair of winding arms and touch rollers contacting each roll or a common touch roller contacting all rolls, said winding arms being disposed at positions changeable in a lengthwise direction of each core, said core chucks being detachably attachable to ends of each core to align the cores along a common center axis; temporary sheet holding means provided for each of the first and second winders, each holding means being movable toward and away from a base of a valley formed by each core and each touch roller or the common touch roller at start of winding, including a holding bar that extends parallel to the wide sheet across a full width of the wide sheet and a sheet-retaining plate that is attached to the holding bar in a state sticking out toward a bottom of the valley, and enabling a front edge of the sheet-retaining plate to temporarily bold a slit sheet against an outside peripheral surface of a touch roller or the common touch roller at a point upstream of a point of contact between each touch roller or the common touch roller and each roll when bringing the holding bar to the valley during winding being stopped; and cutting means that can cut widthwise across the slit sheet held against a touch roller by the front edge of the sheet retaining plate, downstream from the point of contact between each touch roller or the common touch roller and each roll.

The sheet-retaining plate can be one that extends across a full width of the wide sheet.

The holding bar can be provided with a guide member that extends across the full width of the wide sheet parallel thereto, and the cutting means can include a blade movable along the guide member to cut a slit sheet.

The slitter-winder can include adhesive application means for applying adhesive to portions of the mounted winding cores facing the touch rollers to adhere leading edges of the slit sheets.

The slitter-winder can include adhesive application means provided on each of the first and second winders for applying adhesive to portions of the core-chuck-mounted winding cores facing the touch rollers or common touch roller to adhere leading edges of slit sheets.

The adhesive application means can comprise an adhesive applicator that has a pasting head for applying adhesive to a core and adhesive for replenishing the pasting head, a guide for guiding the adhesive applicator parallel to the cores with the pasting head oriented toward a portion of the cores that faces the touch rollers, reciprocating drive means for moving the adhesive applicator along the guide, and advancing and withdrawing means for advancing the pasting head to a position of contact with the cores and withdrawing the pasting head to a retracted position.

The slitter-winder can also include adhesive application means provided on each of the first and second winders for applying adhesive to a portion of a core-chuck-mounted winding core facing a touch roller or the common touch roller to adhere a leading edge of a slit sheet, the adhesive application means comprising an adhesive applicator that has a pasting head for applying adhesive to a core and adhesive for replenishing the pasting head, a guide provided on the holding bar for guiding the adhesive applicator parallel to the cores with the pasting head oriented at a portion of the cores that faces the touch rollers or common touch roller, reciprocating drive means for moving the adhesive applicator along the guide, and advancing and withdrawing means for advancing the pasting head to a position of contact with the cores and withdrawing the pasting head to a retracted position.

The slitter-winder can also include adhesive application means provided on each of the first and second winders for applying adhesive to a portion of a core-chuck-mounted winding core facing a touch roller or the common touch roller to adhere a leading edge of a slit sheet, the adhesive application means comprising an adhesive applicator that has a pasting head for applying adhesive to a core and adhesive for replenishing the pasting head, a guide for guiding the adhesive applicator parallel to the cores with the pasting head oriented at a portion of the cores that faces a touch roller or the common touch roller, reciprocating drive means for moving the adhesive applicator along the guide, and advancing and withdrawing means for advancing the pasting head to a position of contact with the cores and withdrawing the pasting head to a retracted position, and wherein the cutting means includes a blade that is mounted on the adhesive applicator for cutting the slit sheets.

The slitter-winder can include adhesive application means that when the slit sheets are held on the touch rollers by the temporary sheet holding means, sprays adhesive on a portion of the slit sheets facing the mounted winding cores.

The slitter-winder can include winding core supply means for each pair of winding arms that can supply the winding cores between the pair of core chucks.

The winding core supply mean s can compose a pair of trough-shaped holding arms that are attached to the pair of winding arms and can rotate about an axis parallel to the winding cores, and rotation drive means attached to the winding arms that can be selectively set to a downward core supply position and a retraction position, the trough-shaped holding arms comprising front and rear walls extending in a core length direction from opposing edges of a bottom portion facing ends of the cores, a bottom wall that extends forward from a lower portion of the rear wall, a core outlet provided on a lower portion of the front wall, a full-width cutout formed at a lower end of the bottom portion that is used for core chuck insertion and withdrawal, and a core retaining stop that prevents a lowermost core that is not held by a core chuck from falling from the core outlet by not allowing the core to advance to the outlet, and which can be retracted to thereby allow the lowermost core held by the core chuck to be removed from the outlet.

The core supply means can comprise a pair of opposed trough-shaped holding arms that hold the cores in a row, support guide means attached to the winding arms that slidably support the pair of trough-shaped holding arms so that the trough-shaped holding arms can slide toward a center axis of the core chucks with a lower edge of the trough-shaped holding arms guided by the support guide means, and advancing and retracting means that can selectively move the trough-shaped holding arms to a core supply position at which a core supported at a lower end of the trough-shaped holding arms is concentric with the core chucks, and to a position of retraction from a wound roll formed on a core mounted on the core chucks, the trough-shaped arms comprising front and rear walls extending in a core lengthwise direction from opposing edges of a bottom portion facing ends of the cores, a full-width cutout formed at a lower end of the bottom portion that is used for core chuck insertion and withdrawal, and a core-retaining stop that prevents a lowermost core that is not held by a core chuck from falling from the core outlet by not allowing the core to advance to the outlet, and which can be retracted to thereby allow the lowermost core held by the core chuck to be removed from the outlet.

The temporary sheet-holding means can include a revolving arm that supports the sheet-retaining plate, and rotation drive means for turning the revolving arm.

Further features of the invention, its nature and various advantages will be more apparent from the accompanying drawings and following detailed description of the invention.

BRIEF DESCRIPTION OF THE DRAWINGS

FIG. 14 shows the mechanism used by the adhesive applicator to spray adhesive from the pasting head.

FIG. 15 is a side view of another embodiment of the means for applying adhesive to the leading edge of slit sheets according to the invention.

DESCRIPTION OF THE PREFERRED EMBODIMENT

Figure 1:
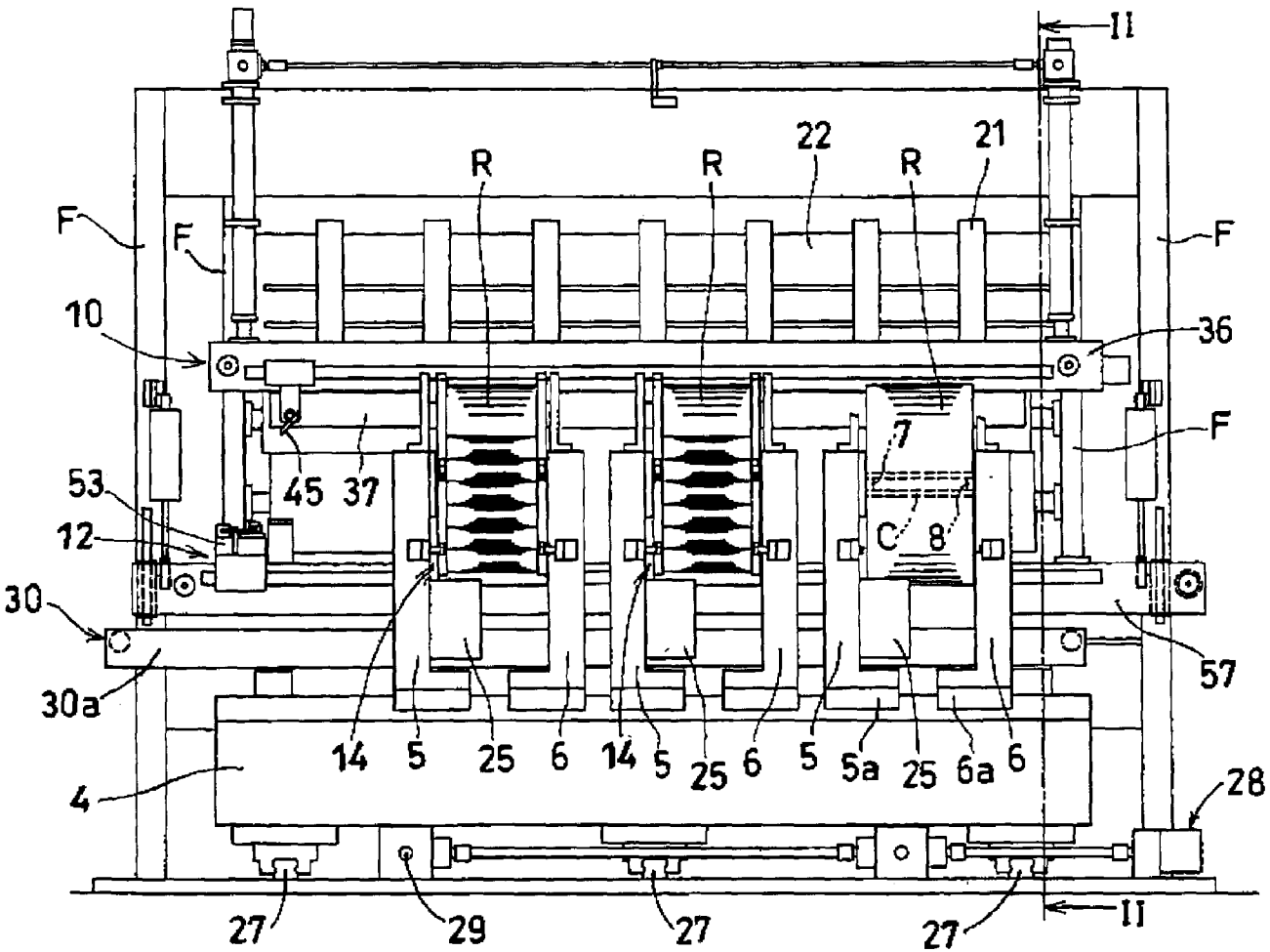
FIG. 1 is a front view of a sheet slitter-winder according to the present invention.
Figure 2:
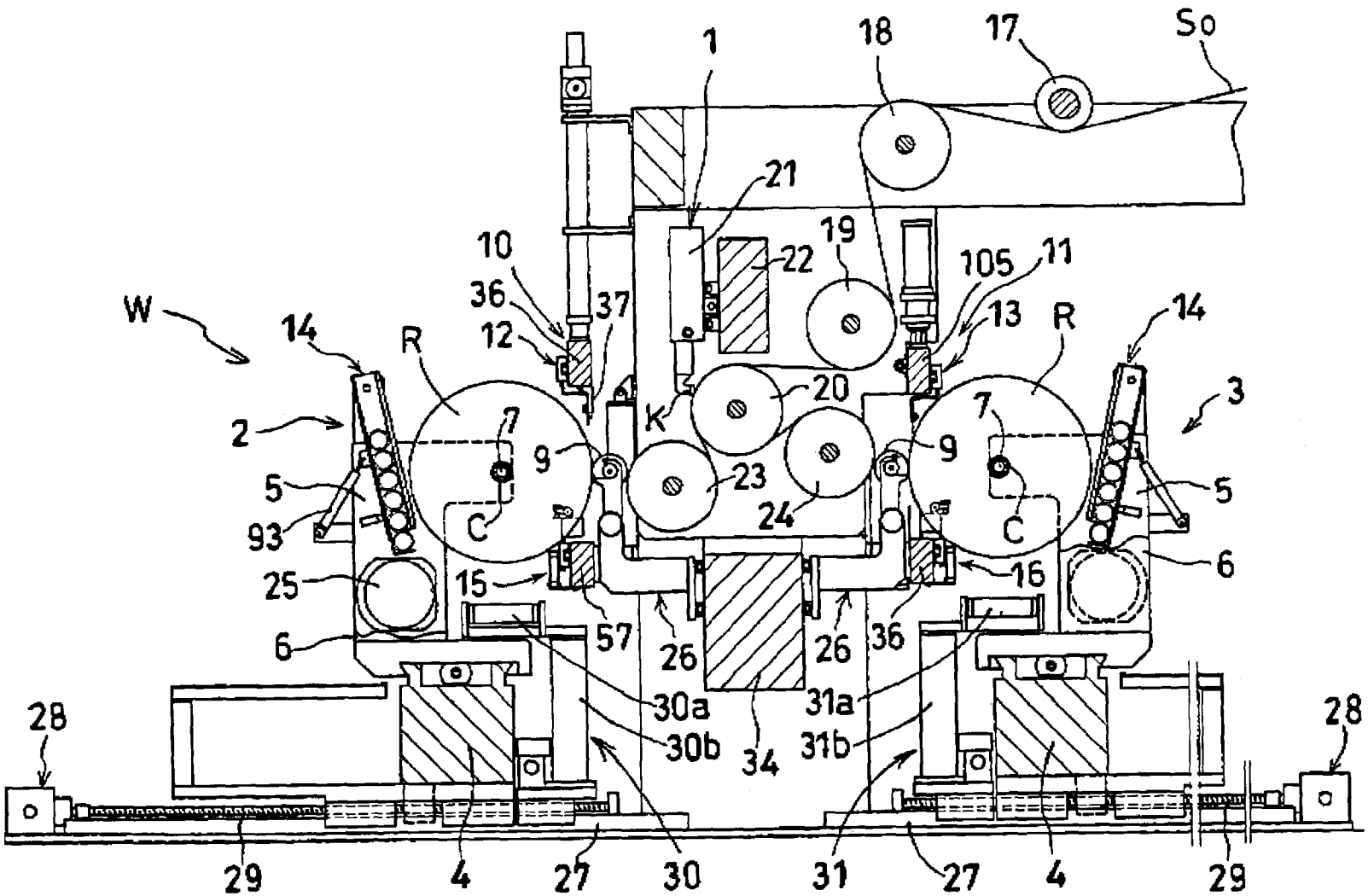
FIG. 2 is a cross-sectional view along line II—II of the sheet slitter-winder of FIG. 1.
Figure 3:
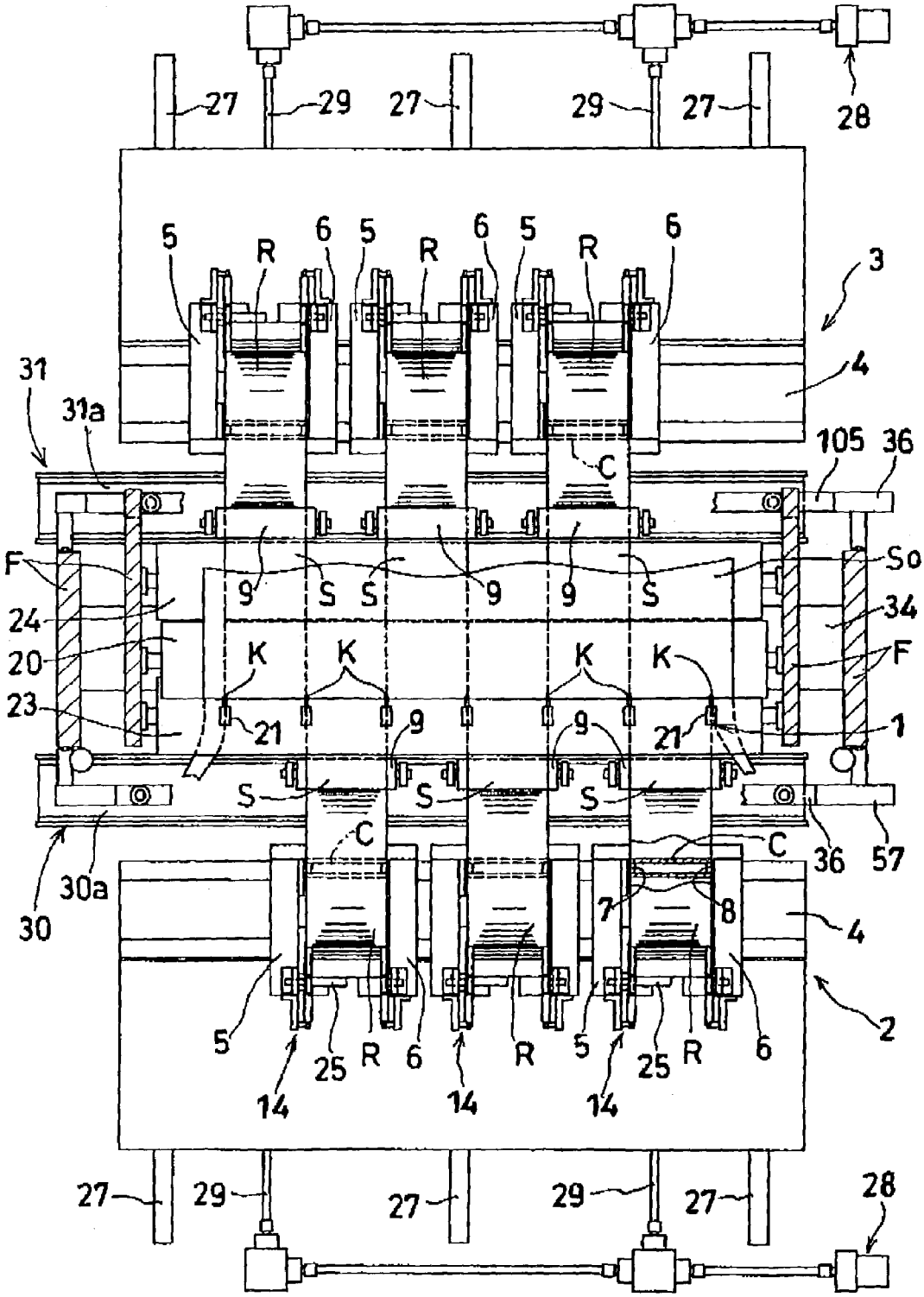
FIG. 3 is a plan view of the sheet slitter-winder of the invention.

FIG. 1 is a front view of an embodiment of the sheet slitter-winder of the invention, FIG. 2 is a cross-sectional view along line II—II of FIG. 1, and FIG. 3 is a plan view of the same sheet slitter-winder. The sheet slitter-winder includes a slitter 1 that cuts a wide sheet SO into a plurality of slits sheets S of predetermined width, and winding apparatus W that simultaneously winds the slit sheets S onto respective cores C that are rotating. The winding apparatus W is constituted of winders 2 and 3 located at the front and back. The slit sheets are supplied alternately to the front winder 2 and the rear winder 3.

Each of the winders 2 and 3 includes a plurality of winding arms 5 and 6, two for each core C, mounted on a winding base 4 that extends parallel to the width direction of the sheet. The winding arms can be repositioned in the longitudinal direction of the cores C. For each pair of winding arms 5 and 6, there is a pair of core chucks 7 and 8 that can be removably inserted into the ends of each core C to support the cores in a line along a common axis. The winders 2 and 3 each have touch rollers 9 in contact with the rolls R formed by the slit sheet S wound around the cores C.

The winders 2 and 3 are provided with respective temporary sheet-holding mechanisms 10 and 11 that can hold slit sheets S attached to completed rolls R against the peripheral surface of the touch rollers 9, and respective cutting mechanisms 12 and 13 that can cut the sheets S across the width of the sheet on the downstream side of the point of contact between touch roller 9 and core C.

In order to reduce the work and time need to mount a new core on the core chucks 7 and 8 after removing a completed roll R, each pair of winding arms 5 and 6 is provided with a core supply mechanism 14. To also reduce the work and time needed to apply adhesive to a new core C to adhere the leading edge of a slit sheet S held by the temporary sheet-holding mechanism 10 or 11, the winders 2 and 3 are provided with respective adhesive application mechanisms 15 and 16. The wide sheet SO coming from a source roll, not shown, is transported via guide rollers 17, 18 and 19, to a guide roller 20 that is grooved on its peripheral surface.

The slitter 1 is a conventional slitter that uses blades K on a plurality of blade bases 21 that can be positioned at various points along a guide support frame 22 to change the position of the blades K to cut the wide sheet SO on the guide roller 20 into two or more strips sheets S having the same or different widths. The sheets S thus slit are fed alternately to guide rollers 23 and 24 and thereby guided to the touch rollers 9. End trim is cut from the wide sheet S with a trimmer (not shown).

Since the opposed winders 2 and 3 have the same structure and operation, for the sake of simplicity the just the front winder, winder 2, will be described below.

The core chucks 7 and 8 are conventional ones such as those disclosed by JU-A SHO 52-62784 and Japanese Utility Model Registration No. 2554803. Relative to the winding arms 5 and 6, the chucks can be moved along the axis of the cores C to enable the cores to be supported by the insertion of the chucks at each end of the core. In this way, the cores C disposed on the winding arms 5 and 6 are aligned in a row along a common center axis.

A winding motor 25 affixed to each winding arm 5 rotates the core C to thereby wind the slit sheets S. The rotational force of the motor 25 is transmitted to the core chuck 7 by a transmission means that is not shown. A conventional core-gripping means is used to prevent slipping between the core chuck 7 and the core C To enable a core C having a length corresponding to the width of the slit sheet S to be mounted on the chucks 7 and 8, the respective bases 5*a* and 6*a* of the winding arms 5 and 6 can be slidably moved on the winding base 4 and fixed at the required position.

There is a touch roller 9 for each slit sheet S. Each touch roller is supported by means of a touch roller supporter 26 that allows the touch roller to contact the core C on the core chucks 7 and 8. The touch rollers are thus disposed in a row across the width of the sheet. As more of the sheet is wound on a roll R, the radius of the roll increases. To allow the distance between the touch roller 9 and the core C to increase to accommodate the increasing radius of the roll R, a drive mechanism 28 is provided that can slidably move the base 4 back along rails 27 that extend in the longitudinal direction of the sheet. The drive mechanism 28 is a conventional one comprising a threaded rod 29 and a nut affixed to the base 4. This allows the base 4 and touch roller 9 to be moved backward or forward by rotating the rod 29 backward or forward. Such a mechanism is described in JP-A HEI 7-80597.

The winders 2 and 3 are provided with respective transporters 30 and 31 that are disposed in the space between rolls to enable completed rolls to be removed. The transporters 30 and 31 include conveyors 30*a* and 31*a*, and elevators 30*b* and 31*b* that can be moved along the rails 27.

Figure 4:
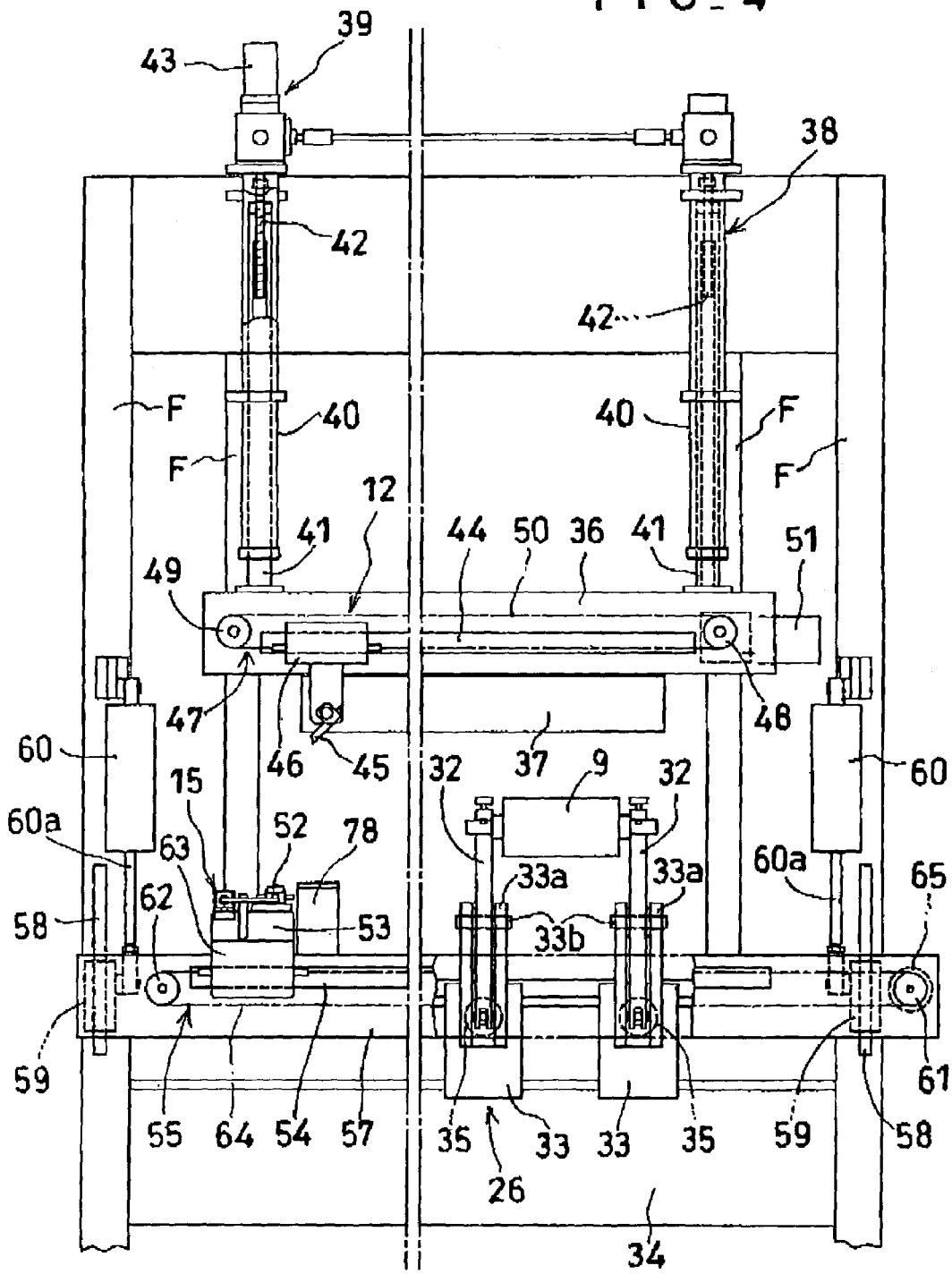
FIG. 4 is a front view for explaining the touch roller supporter, temporary sheet-holding mechanism, cutting mechanism and adhesive application mechanism.
Figure 5:
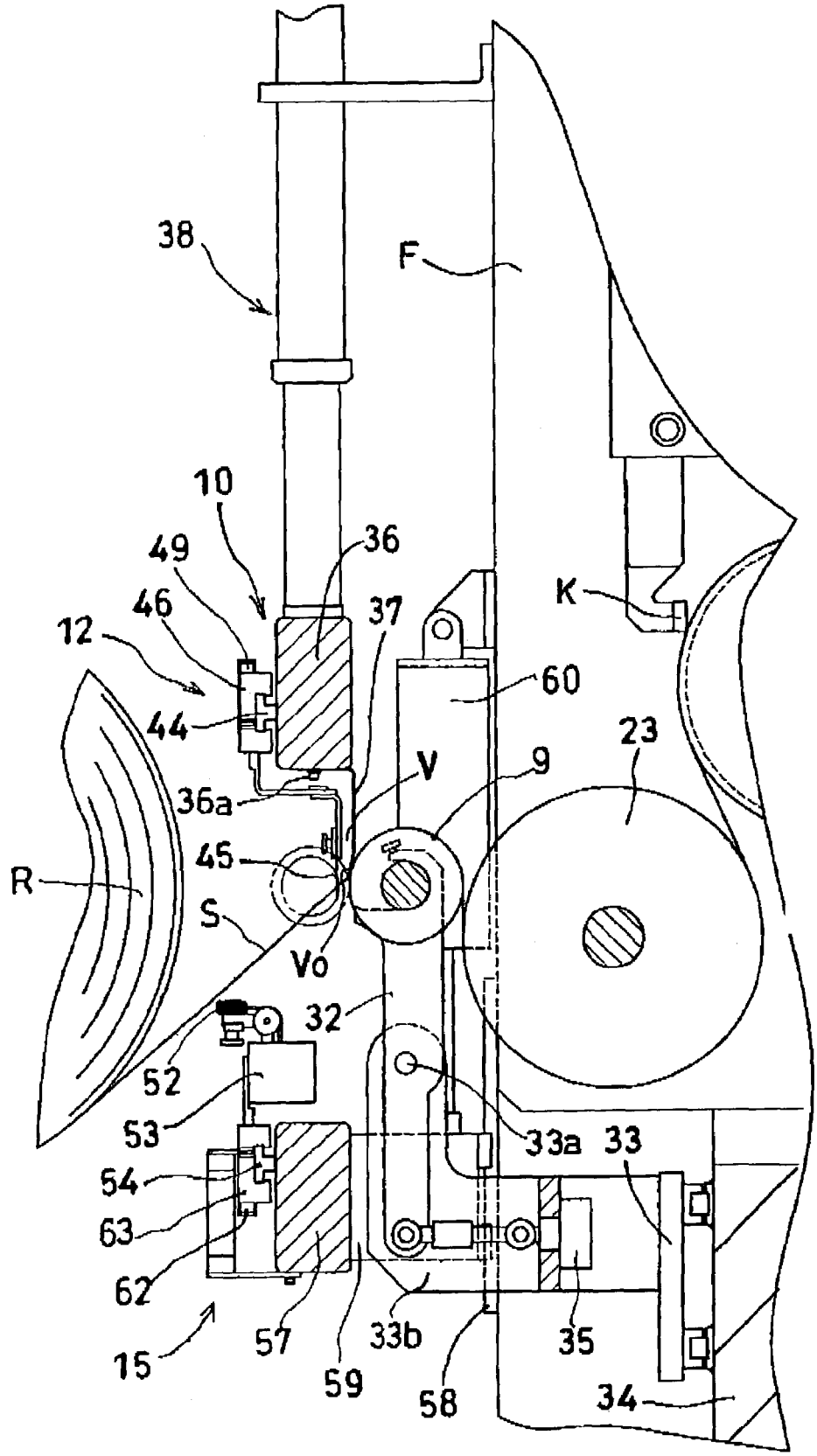
FIG. 5 is a side view showing a slit sheet being temporarily held by the temporary sheet-holding mechanism of FIG. 4.
Figure 6:
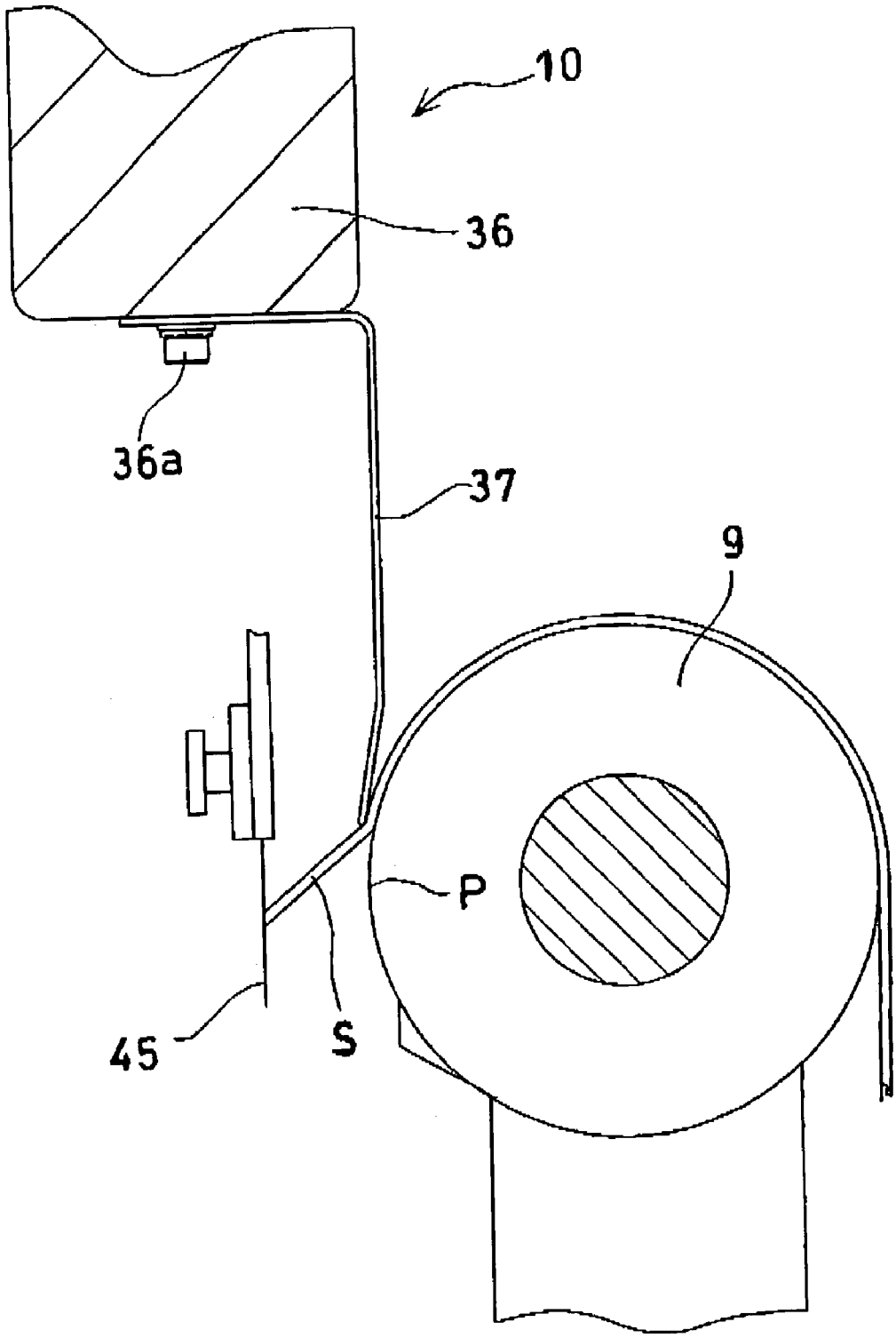
FIG. 6 is a drawing in which the sheet held by the sheet-holding mechanism of FIG. 4 has been cut.
Figure 7:
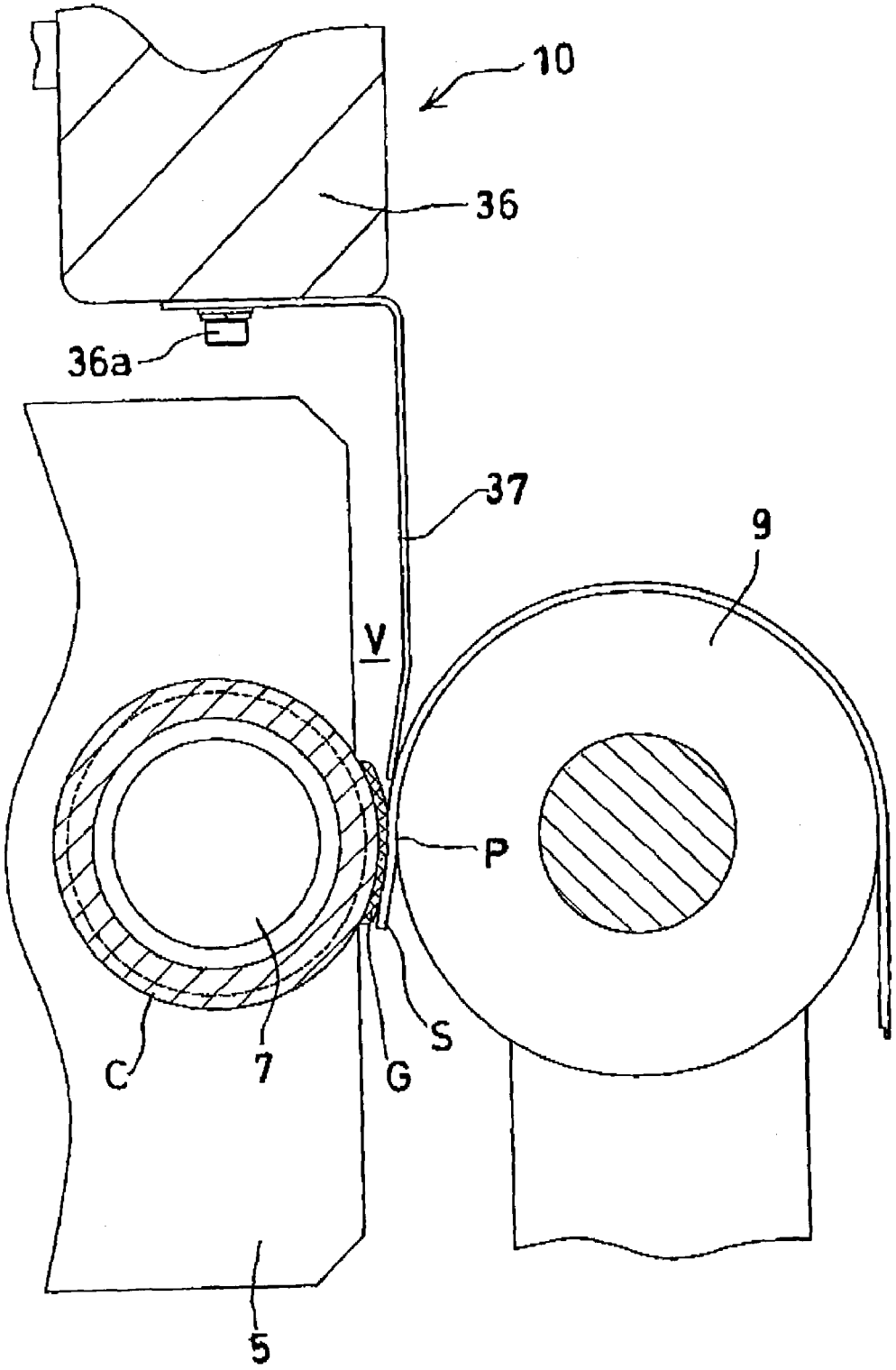
FIG. 7 shows a core at the winding start position, to which adhesive has been applied.

To explain the touch roller supporter, the front temporary sheet-holding mechanism, cutting mechanism and adhesive application mechanism, FIG. 4 shows the front winder with the portion in front of the touch rollers removed. FIG. 5 is a side view showing the slit sheet being temporarily held by the front temporary sheet-holding mechanism, FIG. 6 shows when the sheet thus held is cut, and FIG. 7 shows the cut end of the sheet adhered to a fresh core at the winding start position.

The touch roller supporter 26 is a conventional type comprising a pair of roller-holding arms 32 that urges the touch roller 9 against the core C, and support bases 33 for the holding arms 32. On the guide support frame 34, the base 33 can be moved parallel to the long axis of the touch roller 9 and affixed at a predetermined position. This enables the touch roller 9 having a length corresponding to the width of the slit sheet S to be held at a position where it opposes the sheet S. To enable the pressure of the contact between the touch roller 9 and the roll R to be precisely regulated, the holding arms 32 are rotatably attached to an arm portion 33*a* of the base 33 by a pin 33*b*, and a hydraulic pressure cylinder device 35 that imparts a desired turning force to the holding arms 32 is provided between the base 33 and the holding arms 32.

The temporary sheet-holding mechanism 10 has a holding bar 36 that can move down toward, and up away from, the floor VO of a valley V formed by the touch roller 9 and core C at the start of the winding, indicated in FIG. 5 by the double-dot line, and a sheet-retaining plate 37 affixed to the holding bar 36. The sheet-retaining plate 37 extends parallel to the lengthwise direction of the touch roller 9, and one end in the widthwise direction (along the vertical, with respect to FIG. 4) projects from the holding bar 36 toward the valley floor VO. The holding bar 36 and sheet-retaining plate 37 each has a length that corresponds to the total width of the wide sheet SO, enabling slit sheets S attached to completed rolls to be held against the touch rollers 9 regardless of the length of the touch rollers 9 or the relationship of the touch rollers 9 within the winding area.

The sheet-retaining plate 37 can be a single plate member formed of steel or of a plastic or other such material having a suitable degree of flexibility, or can be composed of a plurality of plate members set in a line along the holding bar 36, with or without spaces between the plate members. The plate is affixed to the holding bar 36 by a bolt 36*a*. The shape of the plate member constituting the sheet-retaining plate 37 is not limited to that shown in the drawings, and may be formed with numerous slits extending in the widthwise direction of the slit sheet, from the front to the back edge. A guide member 38 guides the movement of the holding bar 36 toward and away from the floor VO of the valley V, and by means of a drive 39, the holding bar 36 can be moved to the retracted position shown in FIG. 2 and to the forward position shown in FIG. 5.

The sheet-retaining plate 37 is positioned on the holding bar 36 so that when the holding bar 36 is moved to the forward position, the sheet-retaining plate 37 pushes the slit sheet S against the peripheral surface of the touch roller 9 slightly upstream of the point of contact P between the touch roller 9 and the core C. To maintain the leading end of the slit sheet cut by the cutting mechanism 12 in a suitable state for adhesion to the core C, is it desirable for the point at which it is pushed against the touch roller 9 by the sheet-retaining plate 37 to be as close as possible to the point of contact P between the touch roller 9 and the core C without the sheet-retaining plate 37 interfering with the finished roll and new core.

The guide member 38 shown in FIG. 4 is composed of a pair of guide cylinders 40 affixed vertically to the frame F, and a slidably movable cylinder 41 inside each guide cylinder 40, the end of the movable cylinder 41 being affixed to the holding bar 36. The drive 39 includes a pair of threaded rods 42 in the movable cylinders 41, and a motor 43 that can be driven to synchronously rotate the threaded rods 42 forward or backward. When the motor 43 rotates the rods 42 in one direction, the cylinders 41 move out of the guide cylinders 40, and move back in when the rotation of the rods 42 is reversed.

The cutting mechanism 12 has a blade 45 for cutting the sheet, and can move back and forth parallel to a guide member 44 that extends across the full width of the wide sheet. The blade 45 is supported by means of a movable member 46 that can move on the guide member 44. The movable member 46 can be driven along the guide member 44 by a reciprocating drive 47. The guide member 44 is fixed to the holding bar 36. This is done to simplify the mechanism used to move the cutting mechanism 12 to a position at which the slit sheet can be cut and to a position of retraction from the roll, and to reduce the space occupied by the cutting mechanism 12.

The reciprocating drive 47 includes pulleys 48 and 49 provided near the ends of the holding bar 36, a belt 50 that is mounted on the pulleys 48 and 49 and the ends of which are attached to the movable member 46, and a motor 51 that can rotate pulley 48 backward or forward. When the sheet S is being wound, the sheet-retaining plate 37 is at the retracted position shown in FIG. 4, and the blade 45 is at the standby position at one end of the holding bar 36, also shown in FIG. 4

When the winder 2 shown in FIG. 2 completes the winding of a roll R and stops, the drive mechanism 28 is retracted and the winding arms 5 and 6, with the base 4, retract a set distance from the touch rollers 9, opening up a gap between the touch rollers 9 and the roll R, as shown in FIG. 5. Then, in the temporary sheet-holding mechanism 10, the drive 39 is operated in forward mode, moving the holding bar 36 to the forward position shown in FIG. 5. The front edge 36*a* of the sheet-retaining plate 37 on the holding bar 36 presses the sheets S connected to the rolls against the peripheral surface of the touch rollers 9 at a slightly upstream position of the point of contact P between the touch roller 9 and the roll R. The sheet-retaining plate 37 is able to flex slightly at this point, which makes it possible to resiliently push against the sheets S. The slit sheets can therefore be securely held, even when there is some attachment or machining error or the like.

When the sheets S are thus held by the holding bar 36 moving to the forward position, the motor 51 of the cutting mechanism 12 is activated to rotate the pulley 48 counter-clockwise with respect to FIG. 4, whereby the movable member 46 is moved near to the pulley 48 at the right. The motor 51 is then reversed, bringing the blade 45 back to the standby position. Thus, the blade 45 and movable member 46 are moved reciprocally along the guide member 44, thereby cutting the sheets S connected to the rolls at the front end. FIG. 6 shows when the sheets have been cut and the upstream end of each of the sheets S is held against the touch rollers 9. Each sheet S is held by the temporary sheet holding mechanism 10 until a new core is brought to the winding start position, as shown in FIG. 7.

Figure 19:
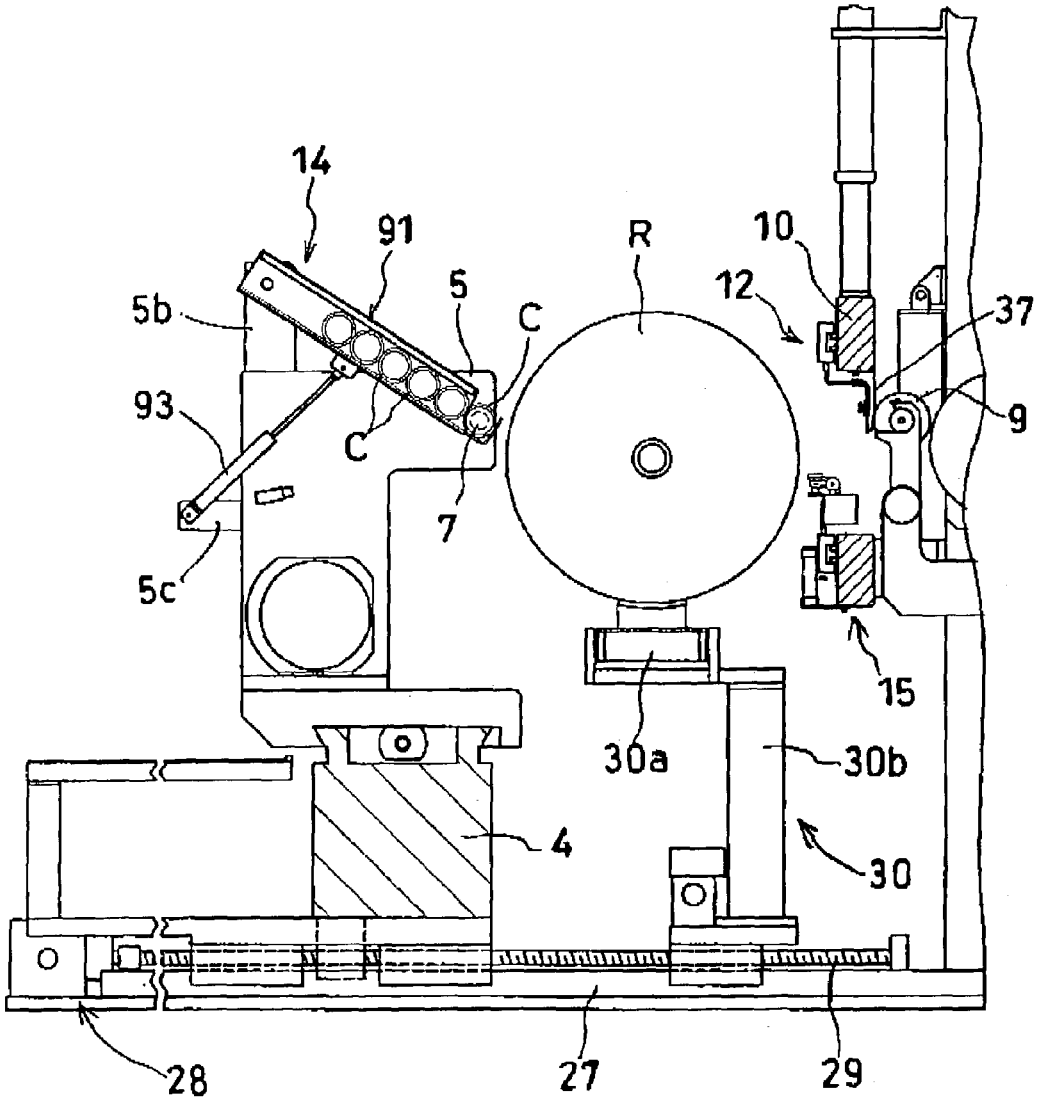
FIG. 19 is a side view showing the trough-shaped holding arms in the core supply position.

In this embodiment, upon completion of the cutting of the slit sheets S, the winding arms 5 and 6 are retracted, the roll R is moved to the transport position and the conveyor 30*a* of the transporter 30 is moved along the rails 27 to a position directly below the roll R and raised by the elevator 30*b* until the roll R rest on a palette on the conveyer. Each pair of winding arms 5 and 6 is then opened to release the roll R from the core chucks 7 and 8. When each roll R is thus released, the winding arms 5 and 6 are further retracted together with the bases 4, as shown in FIG. 19, and the roll R is then moved out by the conveyor 30*a*.

The core supply mechanism 14 then brings a fresh core into position to be held between each pair of core chucks 7 and 8. The drive mechanism 28 is then activated to advance the winding arms 5 and 6 with each base 4 to the adhesive application position. The adhesive application mechanism 15 is then activated to apply adhesive to the part of each core C facing the touch rollers 9. Next, the drive mechanism 28 is operated to move each base 4 further forward to the winding start position, at which point the touch rollers 9 are brought into contact with the cores C, clamping the slit sheets S therebetween, whereby the leading end of each slit sheet is adhered to the cores C on the winder 2 by means of the adhesive applied to the cores. The drive 39 is then used to retract the holding bar 36 and sheet-retaining plate 37.

If the adhesive applied to the cores C is spread across the whole core length from edge to edge, excess adhesive may seep out lengthwise and adhere to the edges of a roll R being wound, resulting in a defective roll. Also, when the sheet being wound is thin plastic film or the like that is prone to stretching, the sheet can be rendered defective by wrinkling caused by the winding tension being concentrated on the adhesive portions. This can be prevented by the use of the adhesive application mechanisms 15 and 16 shown in. FIG. 2.

Figure 8:
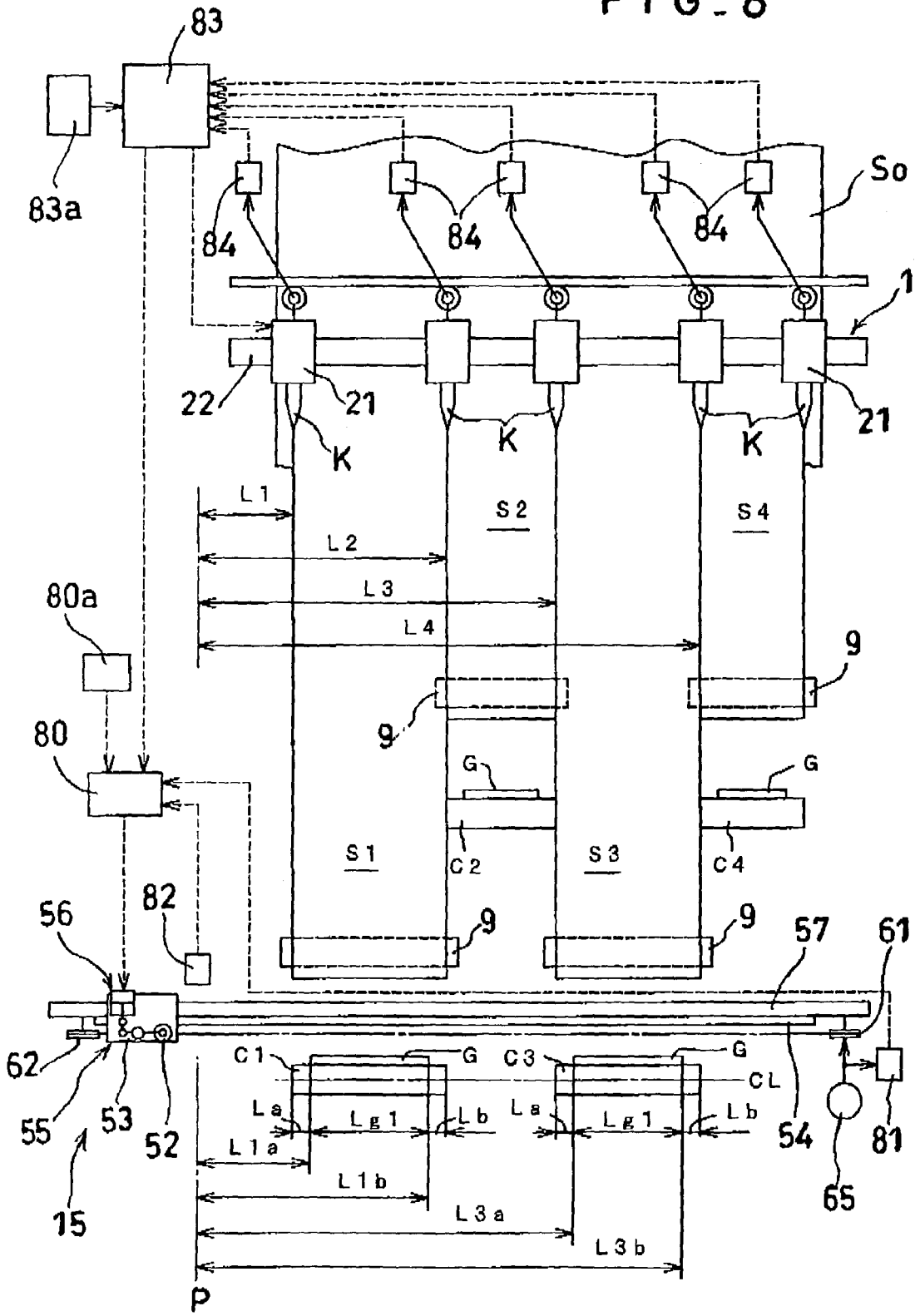
FIG. 8 shows the adhesive application mechanism used in the sheet slitter-winder of the invention.

FIG. 8 is a diagram for explaining the adhesive application mechanism 15 shown in FIG. 2. The adhesive application mechanism 15 includes a pasting head 52 for applying adhesive G to the core C, an adhesive applicator 53 that contains adhesive for replenishing the pasting head 52, a guide 54 for guiding the adhesive applicator 53 parallel to the cores C with the pasting head 52 directed at the portion of the cores C that faces the touch rollers 9, a reciprocating drive 55 that can move the adhesive applicator 53 along the guide 54, and advancing and withdrawing means 56 for advancing the pasting head 52 to a position of contact with the cores C and withdrawing the pasting head to a retracted position.

The guide 54 extends across the full width of the wide sheet SO. To enable the guide 54 to be retracted to a position where it does not interfere with the winding operation, it is affixed to an adhesive applicator support bar 57 to be vertically movable, on the opposite side to where the slit sheet is clamped by the holding bar 36, as shown in FIG. 5. As shown in FIG. 4, the ends of the adhesive applicator support bar 57 are supported by means of a pair of movable supports 59 slidably mounted on rails 58 provided on a frame. The movable supports 59 are connected to the ends of piston rods 60*a* of hydraulic pressure cylinder devices 60 in order to vertically drive the movable supports 59. The end of each of the cylinders of the hydraulic pressure cylinder devices 60 is attached to the frame F.

Figure 9:
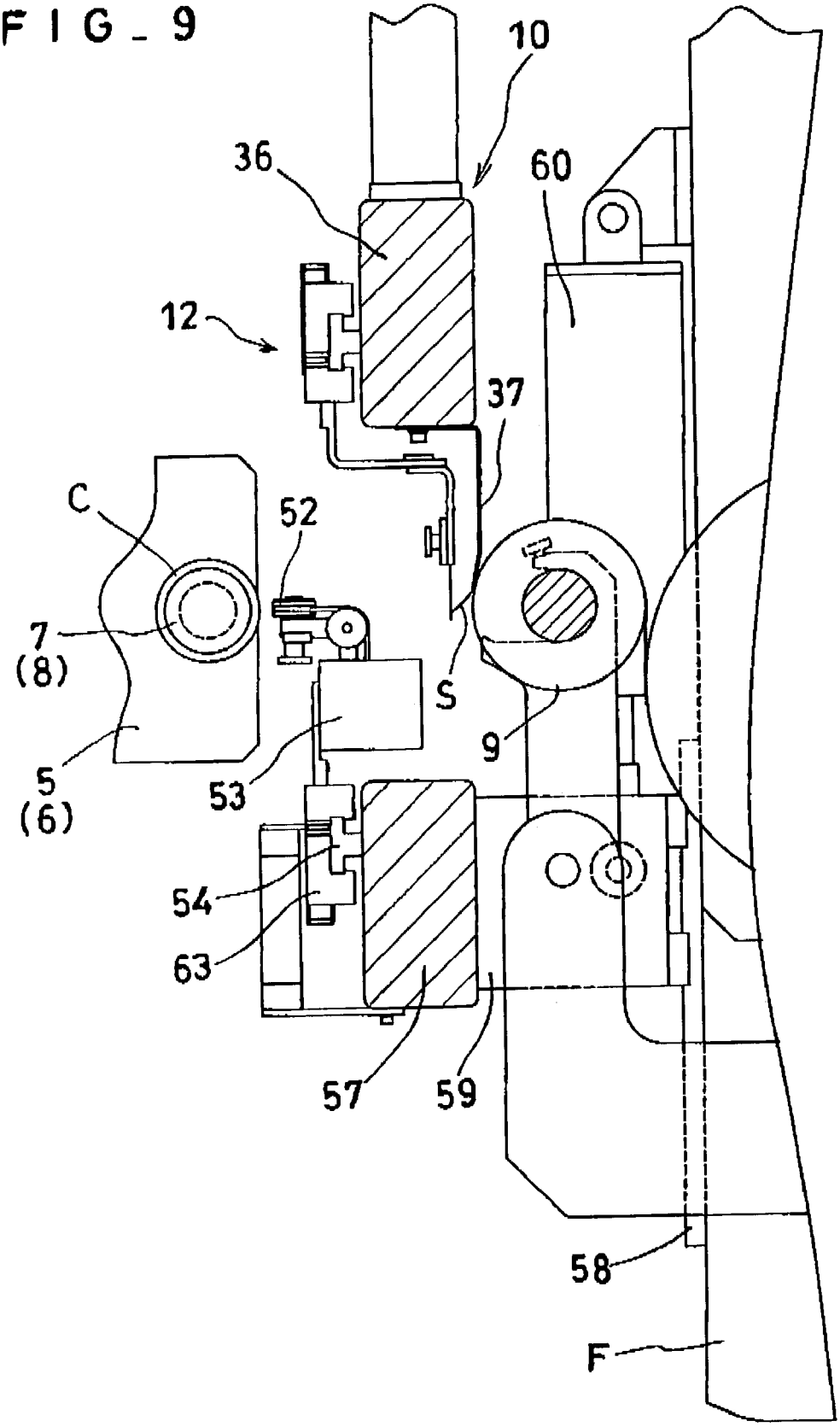
FIG. 9 shows the adhesive applicator of the adhesive application mechanism disposed at a position where it can apply adhesive to a core.

When the winding arms 5 and 6 fitted with a new core have been advanced to the adhesive application position, as shown in FIG. 9, each hydraulic pressure cylinder device 60 raises its adhesive applicator support bar 57 from the retracted position shown in FIG. 5 until the pasting head 52 is facing the part of the core C to which adhesive is applied, and after the adhesive has been applied to the core C, lowers the adhesive applicator support bar 57 back to the retracted position.

The reciprocating drive 55 includes pulleys 61 and 62 disposed near the ends of the adhesive applicator support bar 57, a belt 64 that goes around the pulleys 61 and 62 and the ends of which are attached to movable member 63, and a motor 65 that can rotate the pulley 61 backward or forward. When the motor 65 is activated to rotate the pulley 61 clockwise with respect to FIG. 4, moving the adhesive applicator 53 from the standby position at the pulley 61 end to as far toward the pulley 62 end as it can go, the pulley 61 is rotated clockwise, bringing the adhesive applicator 53 back to the standby position.

To eliminate the need to raise and lower the adhesive applicator support bar 57, the adhesive applicator 53 can be affixed to the movable member 63 so that the pasting head 52 faces the adhesive application point of the core C even when the adhesive applicator support bar 57 is in the retracted position shown in FIG. 5.

Figure 10:
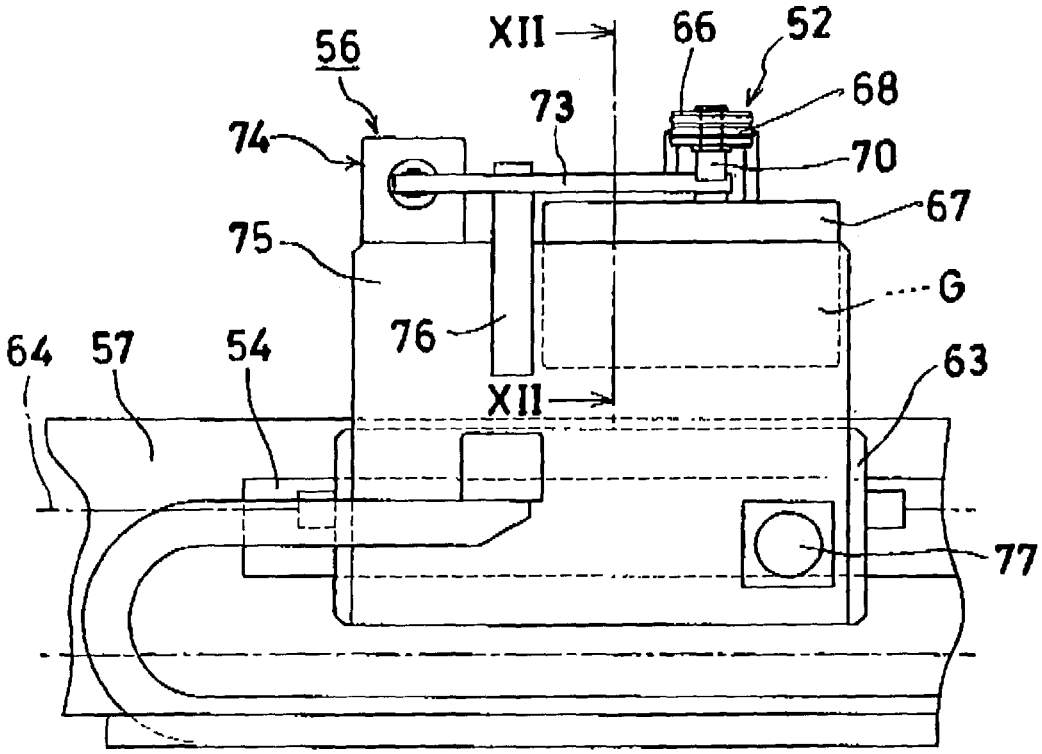
FIG. 10 is a front view of the adhesive applicator of FIG. 9.
Figure 11:
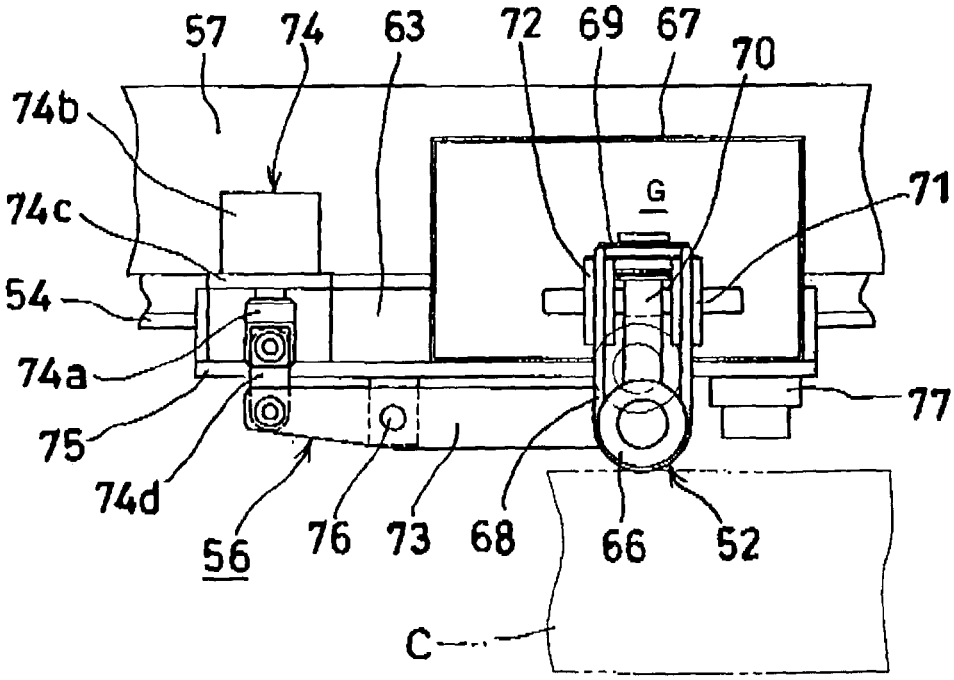
FIG. 11 is a plan view of the adhesive applicator of FIG. 9.
Figure 12:
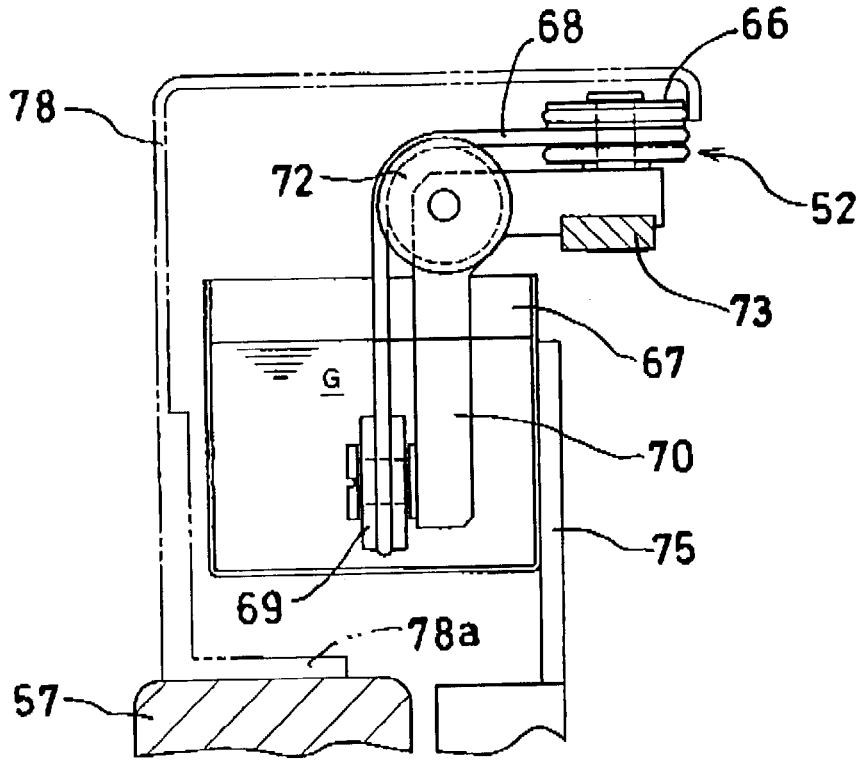
FIG. 12 is a cross-sectional view along line XII—XII of FIG. 10.

FIG. 10 is a front view of the adhesive applicator, FIG. 11 is a plan view of the applicator, and FIG. 12 is a cross-sectional view in the direction along line XII—XII in FIG. 10. The pasting head 52 is comprised of an application roller 66 and an endless belt 68 for supplying adhesive G in a container 67 to the peripheral surface of the roller 66. The adhesive G put into the container 67 is, for example, a vinyl acetate-based paste, starch glue or other such liquid adhesive. The endless belt 68 is mounted on the application roller 66 and a guide pulley 69 positioned in the container 67 to be steeped in the adhesive G.

To enable the application roller 66 to be rolled along the length of the core surface, the application roller 66 is oriented so that the center axis thereof is perpendicular or substantially perpendicular to an axial line extending radially from the core center out through the adhesive application portion on the core surface. Here, the points of contact between cores and touch rollers are on a horizontal line that passes through the center of the cores and the application roller 66 is higher than the container 67, so that as shown in FIG. 11, the support member 70 that supports the application roller 66 is hook-shaped, with the application roller 66 being rotatably supported on a part of the upper surface in the vicinity of the end of the horizontal portion, and the guide pulley 69 being rotatably attached to the rear of the lower end of the portion that extends downward. Intermediate pulleys 71 and 72 are provided beside the bend of the support member 70. An endless belt 68 mounted on the pulleys 71 and 72 runs along the support member 70.

The adhesive applicator 53 has an advancing and withdrawing means 56 composed of a movable arm 73 that supports the pasting head 52, and a hydraulic pressure cylinder device 74 for moving the movable arm 73. The movable arm 73 is attached so that it can rotate about a shaft 76 fixed to a base 75 of the adhesive applicator 53. The support member 70 is affixed to one end of the movable arm 73. The cylinder 74*b* of the hydraulic pressure cylinder device 74 is affixed to the base 75 by means of a bracket 74*c*. A piston rod 74*a* is connected to the other end of the arm 73 by conventional coupler 74*d*, and is operated by means of a fluid supplied under pressure via a switching valve 77 attached to the base 75. When the pasting head 52 is moved to the forward position indicated in FIG. 11 by a solid line by the advancing and withdrawing means 56 while the adhesive applicator 53 is being moved along the guide 54 by the reciprocating drive 55 shown in FIG. 4, the pasting head 52 is urged toward the core C and the frictional force between the core C and the pasting head 52 turns the application roller 66 and the endless belt 68. The movement of the endless belt 68 provides the application roller 66 with a continuous supply of adhesive G from the container 67. Therefore, with this adhesive application mechanism 15, the area of contact between pasting head 52 and core C is provided with a stable supply of adhesive G from the container 67, ensuring that the ends of the slit sheets S are securely adhered to the cores C.

To supply the pasting head 52 with adhesive that has not dried in the container 67 before the adhesive applicator 53 reaches the position at which it starts applying adhesive to the first core C, it is preferable to provide an engaging member 78 of a specified length to rotate the application roller 66 with the adhesive applicator 53 at a specific position in the vicinity of the standby point (FIG. 4 and FIG. 12). The base portion 78*a* of the engaging member 78 is affixed to the adhesive applicator support bar 57 and is formed not to impede the travel of the adhesive applicator 53. Even if adhesive on the surface of the application roller 66 dries during standby at the standby position, the application roller 66 can be supplied with fresh adhesive G from the container 67 by the application roller 66 being rotated by engagement with the engaging member 78 during the forward movement of the advancing and withdrawing means 56.

FIG. 8 shows the adhesive G applied to cores C1 and C3 by the adhesive application mechanism 15 when the four slit sheets S1, S2, S3 and S4 into which the wide sheet SO has been slit by the slitter 1 are being distributed to the two winders. The advancing and withdrawing means 56 is controlled by a controller 80 whereby when the pasting head 52 reaches the positions L1*a* and L3*a* at which application of the adhesive to the front cores C1 and C3 begins the pasting head 52 is advanced to the forward position, and when it reaches the positions L1*b* and L3*b* at which application of the adhesive to the front cores stops the pasting head 52 is retracted from the forward position.

An input unit 80*a*, a rotary encoder 81 that generates pulse signals at each set angle of rotation of the motor 65 of the reciprocating drive 55, and a sensor 82 that detects when the moving pasting head 52 is at a reference position and generates a detection signal are each electrically connected to the controller 80, which is a small computer.

To reduce the work involved in changing the positions of the blade bases 21 when the width or number of slit sheets are changed, the slitter 1 includes a conventional automatic positioning controller 83 that can move each blade base 21 along the guide support frame 22 to a set target position. The automatic positioning controller 83 is disclosed by, for example, JP-B HEI 1-16639, so a detailed description thereof is omitted here Based on slit sheet widths and/or slitting positions input via an input unit 83*a*, the controller 83 can calculate and store target positions for each of the blade bases 21 and can use the detectors 84 to detect the current position of each blade K at any moment.

Figure 13:
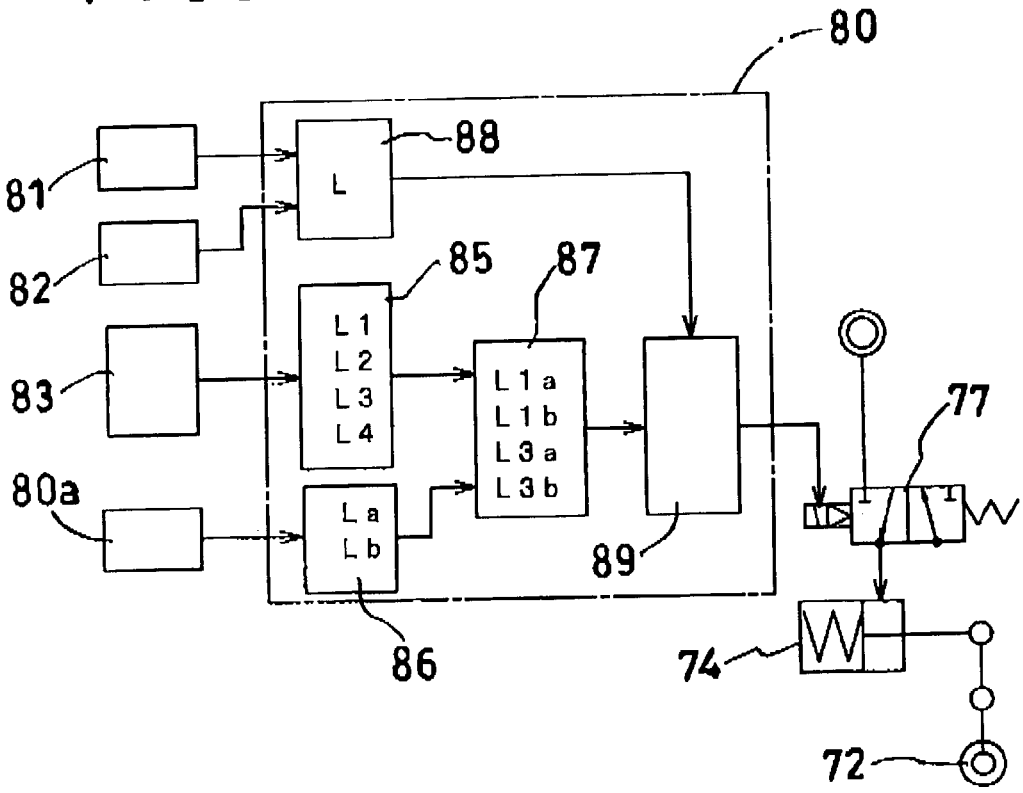
FIG. 13 is a block diagram for explaining the controller used to control the adhesive application mechanism shown in FIG. 8.

As shown in FIG. 13, the controller 80 has a slit position memory means 85 that stores positions L1, L2, L3 and L4 at which the sheet is slit by the slitter 1, memory means 86 that stores the lengths La, Lb of the portions from the edges of the slit sheets S to the edges of the adhesive applied to the core C in which adhesive is not applied, position calculation means 87 that uses the slitting positions and lengths of the adhesive application and non-application portions stored in the slit position memory means 85 and memory means 86 to calculate and store positions L1*a* and L3*a* that mark the start of adhesive application on the slit sheets S1 and S3 and positions L1*b* and L3*b* at which adhesive application stops, position sensing means 88 that detects the current position of the pasting head 52, and control signal generating means 89 that compares the adhesive application start and stop positions from the position calculation means 87 with the detected values from the position sensing means 88 and generates signals to control the advancing and withdrawing means 56 to advance the pasting head 52 from when the detected values from the position sensing means 88 equal the calculated adhesive application start position to when they equal the application stop position.

The slit position memory means 85 stores the distances L1, L2, L3 and L4 from the reference point P in FIG. 8 to the blade K as respective slitting positions. The input unit 80*a* is used to input to the memory means 86 each length La from the core end closest to the standby position of the adhesive applicator 53 in FIG. 8 to the position at which adhesive application starts, and each length Lb from the core end furthermost from the said standby position to the position at which adhesive application stops. The position calculation means 87 uses the computing equations (L1*a*=L1+La, L3*a*=L3+La) to calculate the adhesive application stop positions L1*a* and L3*a* shown in FIG. 8, and uses the equations (L1*b*=L2−Lb, L3*b*=L4−Lb) to calculate the adhesive application stop positions L1*b* and L3*b*.

In the case of FIG. 8, to ensure that if the positions at which the sheet is slit by the slitter 1 are changed, the corresponding changes in the adhesive application positions are made automatically, the slit position memory means 85 of FIG. 13 is used to store sheet-slitting positions L1, L2, L3, L4 from the positioning controller 83. Therefore, the controller 80 can use the slitter 1 slitting positions to calculate the adhesive application start and stop positions and control the operation of the adhesive applicator 53 accordingly. If the slitter 1 is not provided with an automatic positioning controller 83, the controller 80 of FIG. 13 can be used instead, by using the input unit 80*a* to input sheet-slitting position data to the slit position memory means 85.

To use the adhesive application mechanism 15 to apply adhesive G to cores C1 and C3 in the case of FIG. 8, input unit 80*a* is used to input and store the required application and non-application lengths La, Lb in the memory means 86, and sheet-slitting positions L1, L2, L3, L4 from the positioning controller 83 are stored in the slit position memory means 85. A new core on the winding arm 5 located at the adhesive application position is, as shown in FIG. 9, positioned facing the pasting head 52 and the reciprocating drive 55 is used to move the adhesive applicator 53 along the guide member 54. In FIG. 8, when the pasting head 52 reaches the adhesive application start position L1*a* for the first core C1 on which the sheet S1 is to be wound, under the control of the controller 80, the piston rod of the hydraulic pressure cylinder device 74 is advanced, pressing the pasting head 52 against the core C1. When the pasting head 52 reaches the adhesive application stop position L1*b*, the piston rod is retracted, retracting the pasting head 52 from the core C1. Between these points, a specific length of adhesive G is applied from the pasting head 52 to the portion of the core C1 that faces the touch roller 9. This operation is then repeated with respect to core C3. When the adhesive applicator 53 has traversed the full width of the winding area of the winder 2, the motor 65 of the reciprocating drive 55 is put into reverse, bringing the adhesive applicator 53 back to the standby position. With the pasting head 52 at the retracted position, the advancing and withdrawing means 56 is not activated.

The adhesive application mechanism 15 automatically shortens the time it takes to apply the adhesive across the width of the core except in the immediate vicinity of the edges. The operation of the adhesive applicator is controlled by the controller 80 based on the positions at which the slitter 1 slits the sheet, making it possible to apply just the right length of adhesive even when a core is longer than the width of a slit sheet or there is some error in the core length.

If necessary, the adhesive applicator 53 shown in FIG. 8 can be replaced by the adhesive applicator 53A shown in FIG. 14 having a pasting head 301 that sprays the adhesive G from the container 300 onto the core C. The container 300 is affixed to a base 75, and the pasting head 301 is a nozzle able to spray adhesive in a limited area. The pasting head 301 is fixed above the container 300, oriented toward the cores. The adhesive applicator 53A includes a spray mechanism 302 for spraying the adhesive from the pasting head 301. The spray mechanism 302 has a valve 304 that can open and close the passage 303 through which the adhesive is supplied from the container 300 to the pasting head 301. The container 300 is as sealed enclosure into which air under pressure is continuously supplied via a port 300*a*. Thus, when the valve 304 is opened, under the pressure of the air in the container 300, adhesive G is sprayed from the pasting head 301. When a solenoid 305 is energized, a needle valve 306 is moved back off the valve seat against the force of a coiled spring 307, opening the passage 303 to the pasting head 301. When the solenoid 305 is not energized, the force of the coiled spring 307 presses the conical tip of the needle valve 306 onto the valve seat, closing the passage 303. The solenoid 305 is energized when the pasting head 52 is moved to the adhesive application start positions L1*a* and L3*a* of the cores C1 and C3 under the control of the controller 80 shown in FIG. 8, and is de-energized when the pasting head 52 reaches the adhesive application stop positions L1*b* and L3*b* of cores C1 and C3.

Instead of the adhesive application mechanism 15 of FIG. 8, an adhesive spray mechanism 15B can be used that sprays adhesive onto a portion of a slit sheet S held on the touch roller 9 by the temporary sheet-holding mechanism 10, said portion being a portion that faces the core C mounted on core chuck 5, as shown in FIG. 15. The adhesive spray mechanism 15B is constituted such that the adhesive applicator 53A of FIG. 14 is used in place of the adhesive applicator 53 of FIG. 8 and that the pasting head 301 of the adhesive applicator 53A points toward the portion of the core C facing the slit sheet S held on the touch roller 9.

Figure 16:
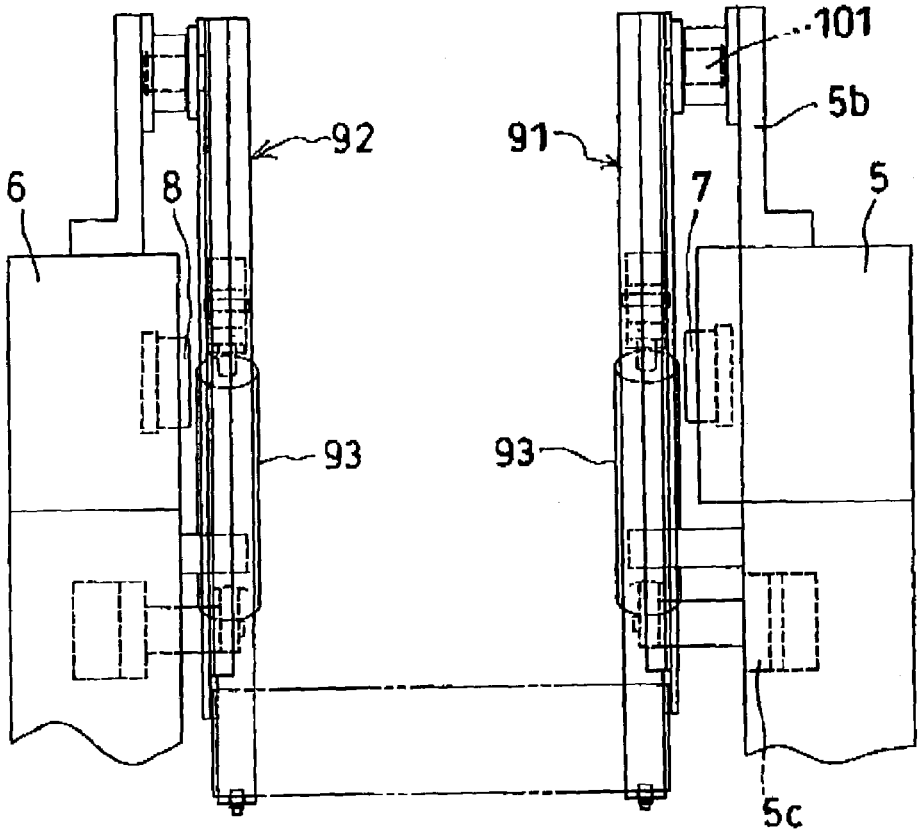
FIG. 16 is a rear view of the core supply means used in the sheet slitter-winder of the invention.
Figure 17:
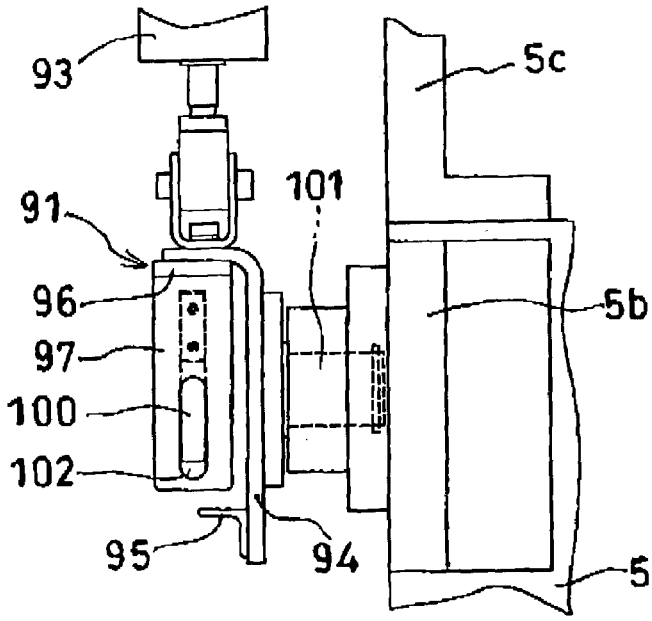
FIG. 17 is a plan view of a trough-shaped holding arm used in the sheet slitter-winder of the invention.
Figure 18:
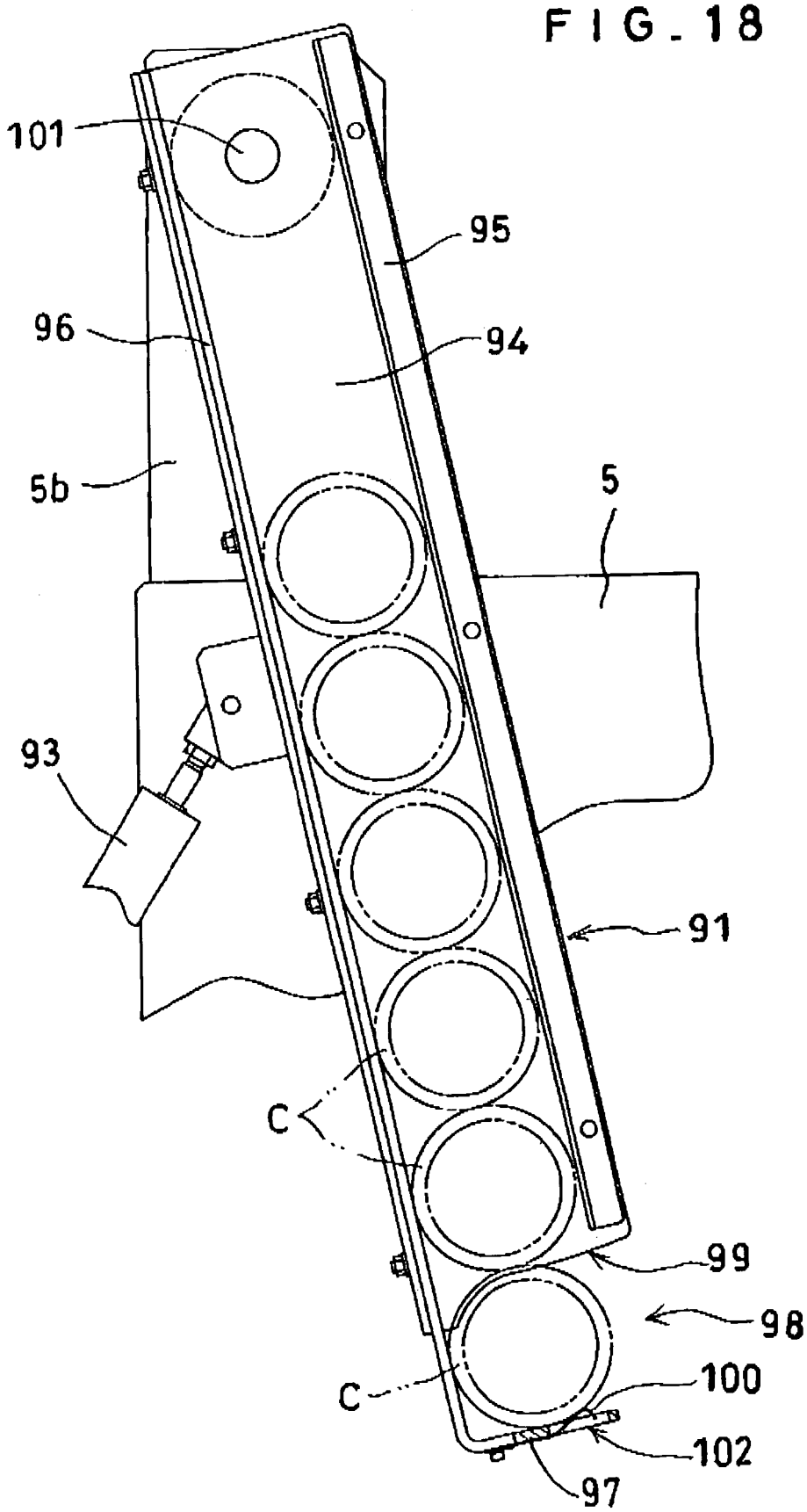
FIG. 18 is side view of a trough-shaped holding arm used in the sheet slitter-winder of the invention.

FIG. 16 is a rear view of the core supply means, FIG. 17 is a plan view of a trough-shaped holding arm, and FIG. 18 is side view of the trough-shaped holding arm. The core supply mechanism 14 comprises trough-shaped holding arms 91 and 92 rotatably affixed to respective winding arms 5 and 6, and rotation drive mechanisms 93 that are rotatably attached to the winding arms 5 and 6 and can be selectively set to a core supply position and a retraction position. The trough-shaped holding arm 91 is shown in the core supply position in FIG. 19 and in the retraction position in FIG. 1. To prevent the cores C from rolling back under their own weight, the rotation drive mechanism 93 can swivel the trough-shaped holding arm 91 up and down.

FIG. 18 is a side view of one of the trough-shaped holding arms. The trough-shaped holding arms 91 and 92 are formed as mirror opposites, so just one, arm 91, will be explained The arm 91 comprises front and rear walls 95 and 96 extending up to a predetermined height in the core length direction from opposing edges of trough bottom 94, a bottom wall 97 that projects forward from the bottom edge of the rear wall 96, a core outlet 98 provided at the lower end of the front wall 95, a cutout 99 provided in the bottom portion that runs from front to back that is used for core chuck insertion and withdrawal, and a core retaining stop 100 that prevents the lowest core that is not held by a core chuck from falling from the core outlet by not allowing the core to advance to the outlet, and can be retracted to thereby allow the bottom core held by a core chuck to be removed from the outlet.

The distance between the front and rear walls 95 and 96 is slightly greater than the diameter of the cores to thereby allow the cores to be inserted into the arm 91, which can thus hold a plurality of cores C that can move along the walls 95 and 96. The winding arm 5 has a bracket 5*b* to which the trough-shaped holding arm 91 is attached by a pivot pin 101, allowing the arm 91 to pivot about an axis parallel to the cores C. One end of the pivot pin 101 is fixed to the trough bottom 94. The distance from the core outlet 98 to the pivot pin 101 is made to be greater than the radius of a wound roll R, so that when the arm 91 is lowered to the core supply position, the bottom core is concentric with the core chuck 7. The distance between the bottoms 94 of each pair of trough-shaped holding arms is made to be slightly greater than the length of the core C.

The rotation drive mechanism 93 is a hydraulic pressure cylinder device. The cylinder is connected to a bracket 5*c* provided on the winding arm 5, and the tip of the piston rod is attached to the arm 91. The core-retaining stop 100 is a plate spring with a suitable spring modulus and is affixed to the lower surface of the bottom wall 97 by a bolt 60 at the rear end, with the front end projecting into the core outlet 98 passage via an opening 102. The resilience of the core-retaining stop 100 prevents cores from moving to the core outlet 98, thereby preventing cores from falling. When the core supply mechanism 14 is to supply new cores to the core chucks, the cores are loaded into the holding arms 91 and 92 in the retracted position, and the arms are then lowered to position a core between the chucks.

When the winding of the sheet onto a roll R is completed, the roll is released and transported out from between the core chucks 7 and 8, and rotation drive mechanism 93 rotates the trough-shaped holding arms 91 and 92 to the core supply position shown in FIG. 19. In this position, the bottom core is between the core chucks 7 and 8, which are inserted to mount the core. The arms 91 and 92 are then rotated back to the retracted position by the rotation drive mechanism 93. The cores C can be removed from the core outlet 98 by pressing down the core-retaining stop 100 on each arm.

The core supply mechanism 14 can maintain a continuous supply of cores to between each pair of arms 91 and 92. If the slitting positions of the slitter 1 are changed, such changes can be accommodated when repositioning the winding arms 5 and 6, thereby automatically adjusting positions of the arms 91 and 92. This arrangement also makes it easier to handle and replenish the core supply mechanism.

In FIG. 2, from the guide roller 23 the slit sheets pass over the touch rollers 9 on the left side and slit sheets from the guide roller 24 pass under the touch rollers 9 on the right side. Therefore, the vertical disposition of the temporary sheet-holding mechanism 11 and cutting mechanism 13 is the reverse to that of the temporary sheet-holding mechanism 10 and cutting mechanism 12. With respect to the two valleys formed between core and touch roller at the start of the winding, in the case of the temporary sheet-holding mechanism 11, the holding bar 36 is positioned so as to be absolutely below the downward-facing valley so that it can face that valley.

Figure 20:
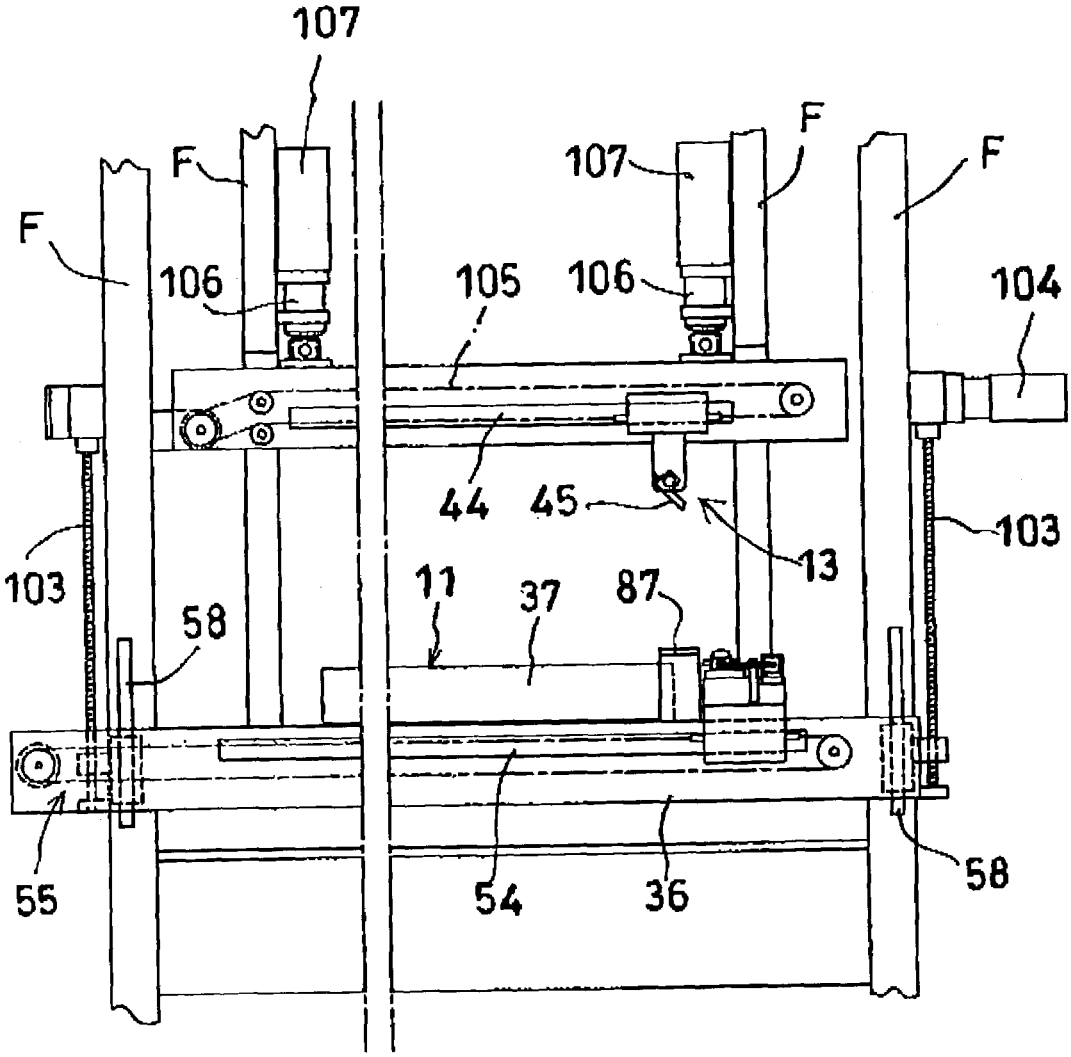
FIG. 20 is a front view for explaining the rear temporary sheet holding mechanism, cutting mechanism and adhesive application mechanism.
Figure 21:
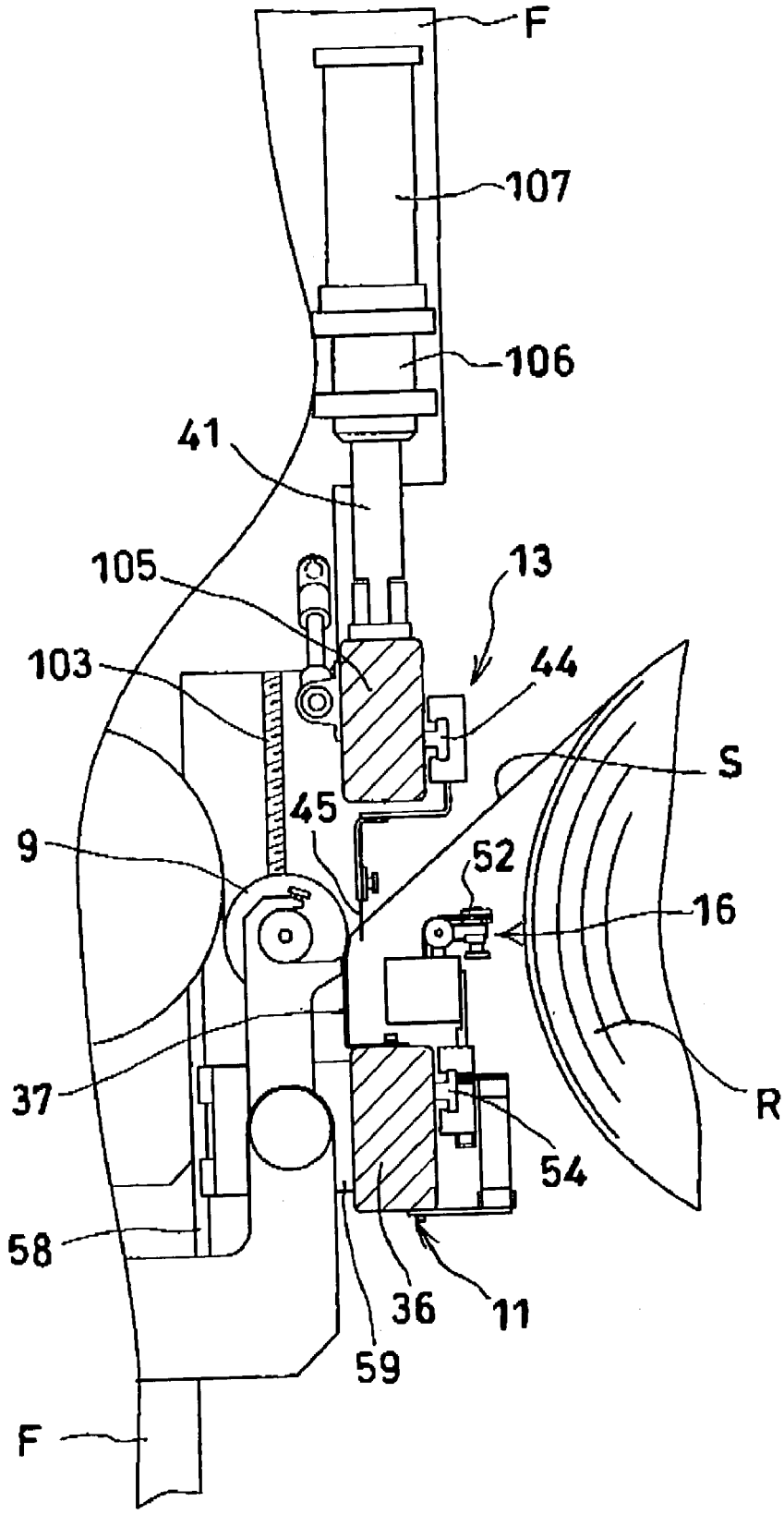
FIG. 21 is a side view of the rear part, showing a slit sheet being temporarily held by the temporary sheet holding mechanism.

FIG. 20 is a front view for explaining the rear temporary sheet-holding mechanism, cutting mechanism and adhesive application mechanism, and FIG. 21 is a side view showing a slit sheet being held by the rear temporary sheet-holding mechanism. With respect to the temporary sheet-holding mechanism 11, the holding bar 36 on the sheet-retaining plate 37 is supported at its end portions by a pair of movable supports 59 slidably mounted on a pair of rails 58. A pair of threaded rods 103 in threaded engagement with the movable supports 59 can be backward or forward in unison by a motor 104. Holding bar 63 can function like the holding bar 36 of the temporary sheet-holding mechanism 10. Like the temporary sheet-holding mechanism 10, the temporary sheet-holding mechanism 11 can hold slit sheets S on the touch rollers 9 by means of the sheet-retaining plate 37.

Adhesive application mechanism 16 has the same structure as the adhesive application mechanism 15 and operates the same way. Supported on the holding bar 36 is a guide 54 that guides the adhesive applicator 53 parallel to the cores C with the pasting head 52 directed at the portion of the cores C that face the touch rollers 9. Also provided on the holding bar 36 is a reciprocating drive 55 for driving the adhesive applicator 53 along the guide 54.

The rear cutting mechanism 13 has a blade 45 for cutting the sheets, and can be moved parallel to a guide member 44 provided on a cutting support bar 105. By means of a drive mechanism, the bar 105 can be moved vertically along a pair of upright guides 106 from the retraction position shown in FIG. 2 to the cutting position shown in FIG. 21. The upright guides 106 are composed of movable cylinders, each having an end affixed to the bar 105, and guide cylinders affixed to frames F that can slide along the outside surface of the movable cylinder. Drive mechanism 107 is a hydraulic pressure cylinder device that drives the other end of the movable cylinders.

Figure 22:
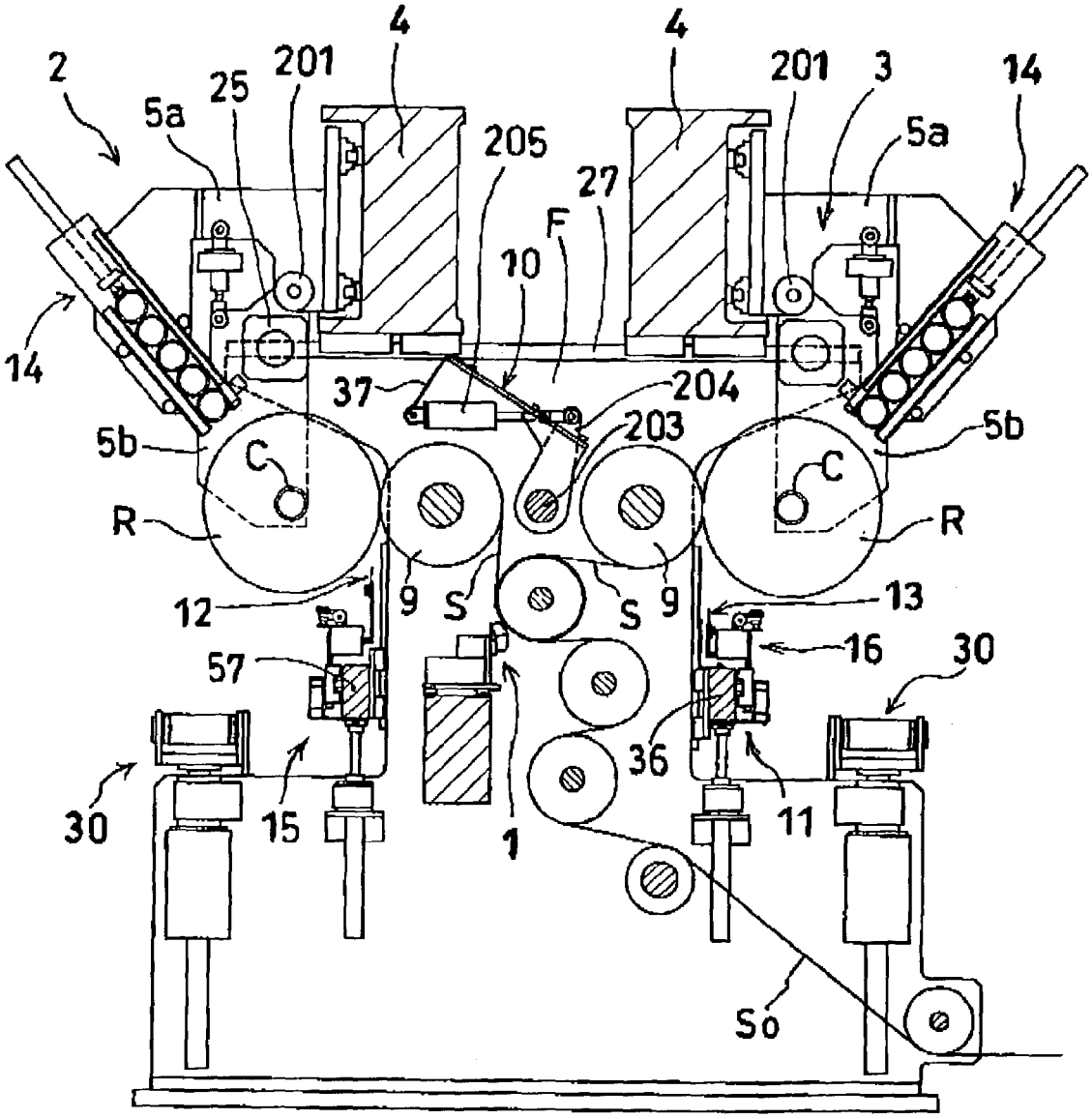
FIG. 22 is a side view of a sheet slitter-winder according to another embodiment of the present invention.
Figure 23:
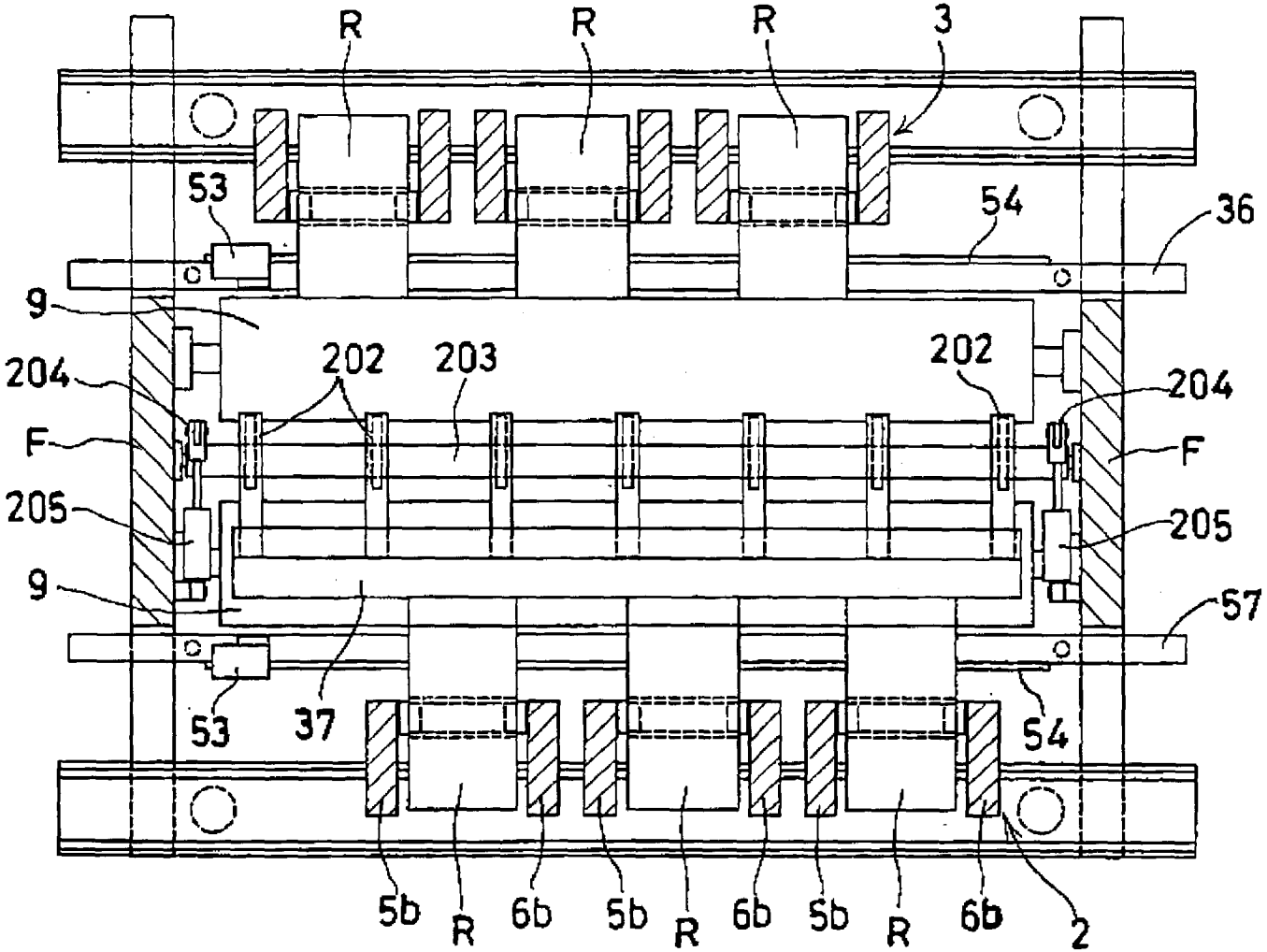
FIG. 23 is a plan view of the sheet slitter-winder of FIG. 22.
Figure 24:
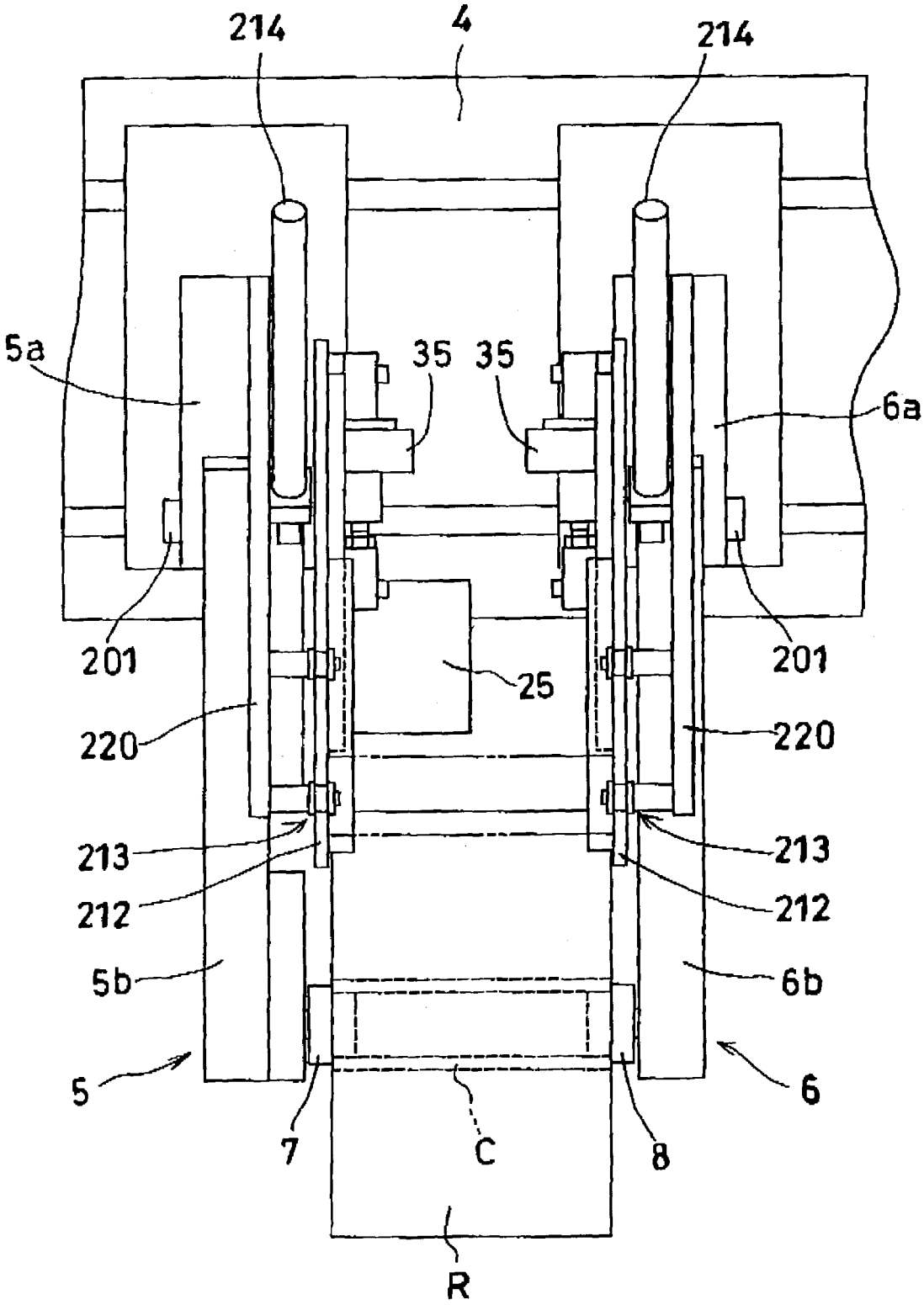
FIG. 24 is a front view of a pair of the winding arms used in the apparatus of FIG. 22.

FIG. 22 is a side view of another embodiment of the slitter-winder of the invention, FIG. 23 is a plan view of the slitter-winder, and FIG. 24 is a front view of a pair of the winding arms used in the slitter-winder. In the case of this slitter-winder, wide sheet SO is guided to the slitter 1 by a group of guide rollers and is slit into sheets S that are supplied alternately to the front winder 2 and the rear winder 3. As shown in FIG. 23, slitters 1 and 2 each have a touch roller 9 used across all rolls that is supported at its ends at a fixed position by a pair of frames F that also support the guide rollers.

The winding arms 5 and 6 allow the cores C to be pressed against the touch rollers 9 at a required pressure during winding. To accomplish this, each pair of winding arms 5 and 6 have a pair of arm portions 5*b* and 6*b* provided with a pair of core chucks 7 and 8. The arm portions 5*b* and 6*b* are rotatably supported on bases 5*a* and 6*a* by a pivot pin 201. Hydraulic pressure cylinder device 35 disposed between the arm portions 5*b* and 6*b* impart a required turning force to the arm portions 5*b* and 6*b*.

A winding motor 25 is affixed to the winding arm 5 to rotate the core C. The bases 5*a* and 6*a* are provided on the winding bases 4 to be slidably movable thereon in the width direction of the sheets. To allow the distance between the touch roller 9 and the cores C to increase to accommodate the increasing radius of the roll R, a drive mechanism (not shown) is provided that can slidably move each base 4 along rails 27 provided on frame F.

For the respective winders 2 and 3, the sheet slitter-winder includes temporary sheet-holding mechanisms 10 and 11, cutting mechanisms 12 and 13, and adhesive application mechanisms 15 and 16 for applying adhesive to the portions of the winding cores facing each touch roller 9. Each pair of winding arms 5 and 6 is also provided with a core supply mechanism 14 to supply fresh cores between each pair of core chucks 7 and 8.

Figure 25:
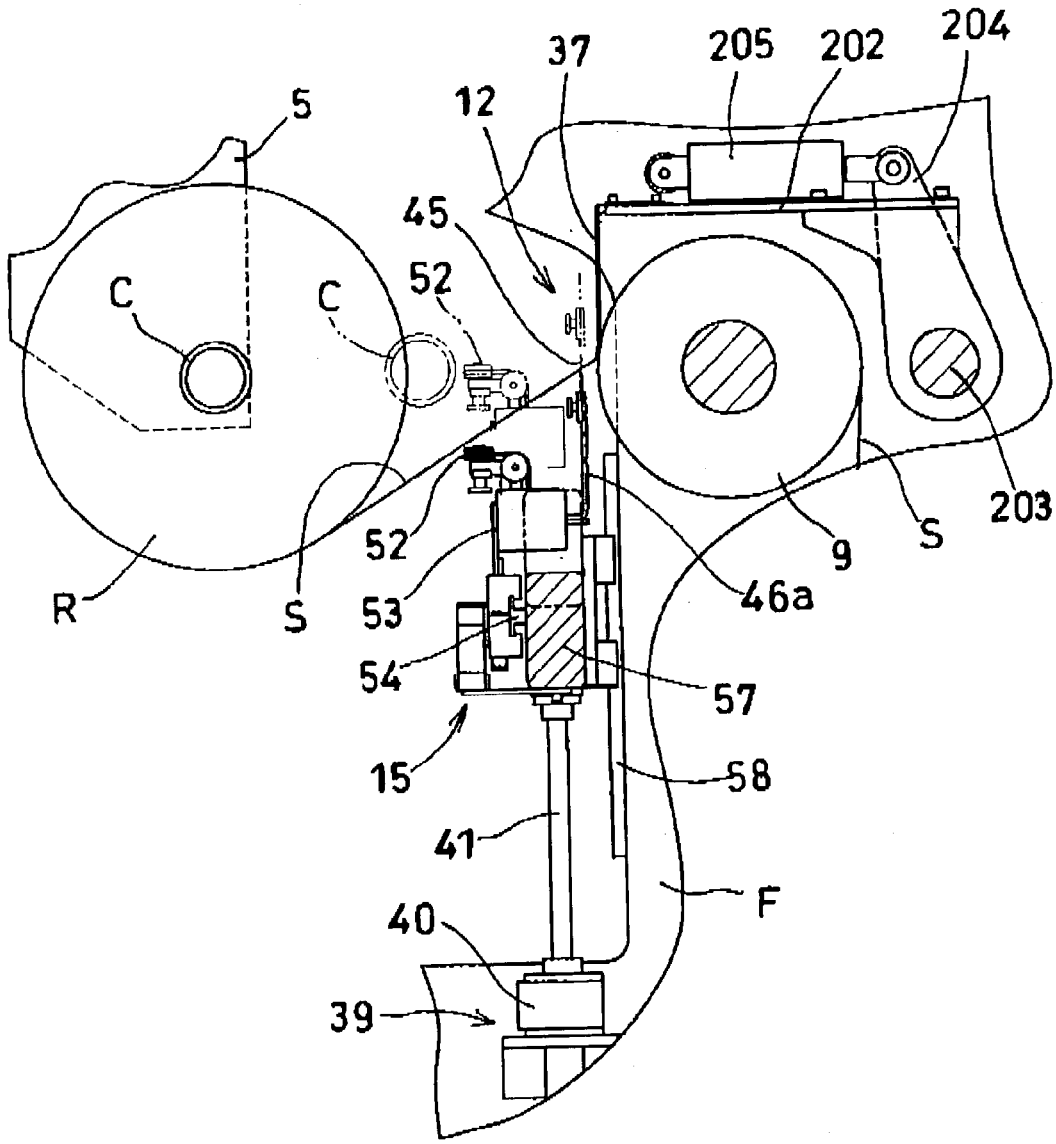
FIG. 25 is a side view of the front apparatus of FIG. 23, showing a slit sheet being temporarily held by the temporary sheet holding mechanism.

Unlike in the case of the embodiment of FIG. 2, there is not enough space to slidably dispose the holding bars above the touch rollers 9. Therefore, as shown in FIG. 25, in the temporary sheet-holding mechanism 10 the sheet-retaining plate 37 is supported by means of a revolving arm 202 that can revolve about an axial line that is parallel to the touch roller 9. The arm 202 is affixed to a shaft 203. The ends of the shaft 203 are rotatably supported by means of the frame F. The sheet-retaining plate 37 attached to the free end of the revolving arm 202 can be moved between a retraction position shown in FIG. 2 and the sheet-holding position shown in FIG. 25, by means of a hydraulic pressure cylinder device 205 that drives a lever 204 provided at each end of the shaft 203.

The adhesive application mechanism 15 shown in FIG. 25 has the same type of constitution as that of the embodiments shown in FIG. 4 and FIG. 5. Specifically, a guide 54 used to guide the adhesive applicator 53 is affixed to an adhesive applicator support bar 57. The bar 57 is slidably mounted on rails 58 affixed to the frame F. The cutting mechanism 12 has a blade 45 attached to the adhesive applicator 53 of the adhesive application mechanism 15. The blade 45 is used to cut the sheet across its width. The blade 45 is supported by a holder 46*a* attached to the base of the adhesive applicator 53.

Jacks 39 at each end of adhesive applicator support bar 57 are used to move the adhesive applicator support bar 57 to the retracted position shown in FIG. 22 while sheet is being wound to the position indicated in FIG. 25 by a solid line when slit sheets attached to the roll are being cut, and to a position, shown by a double-dot line in FIG. 25, at which the pasting head is facing the part of the cores to which adhesive is to be applied, when it is time to apply adhesive to new cores. A motor, not shown, is used to operate the jacks 39, which performs raising and lowering by means of a rod 41 that is moved in and out of a case 40 attached to frame F.

When the slit sheets S are to be cut, reciprocating drive means included in the adhesive application mechanism 15 is operated to move the adhesive applicator 53 along the guide 54. Being on the adhesive applicator 53, the blade 45 moves together with the applicator 53, cutting the slit sheets. At this time, the pasting head 52 of the adhesive applicator 53 is maintained in the retracted position.

Figure 26:
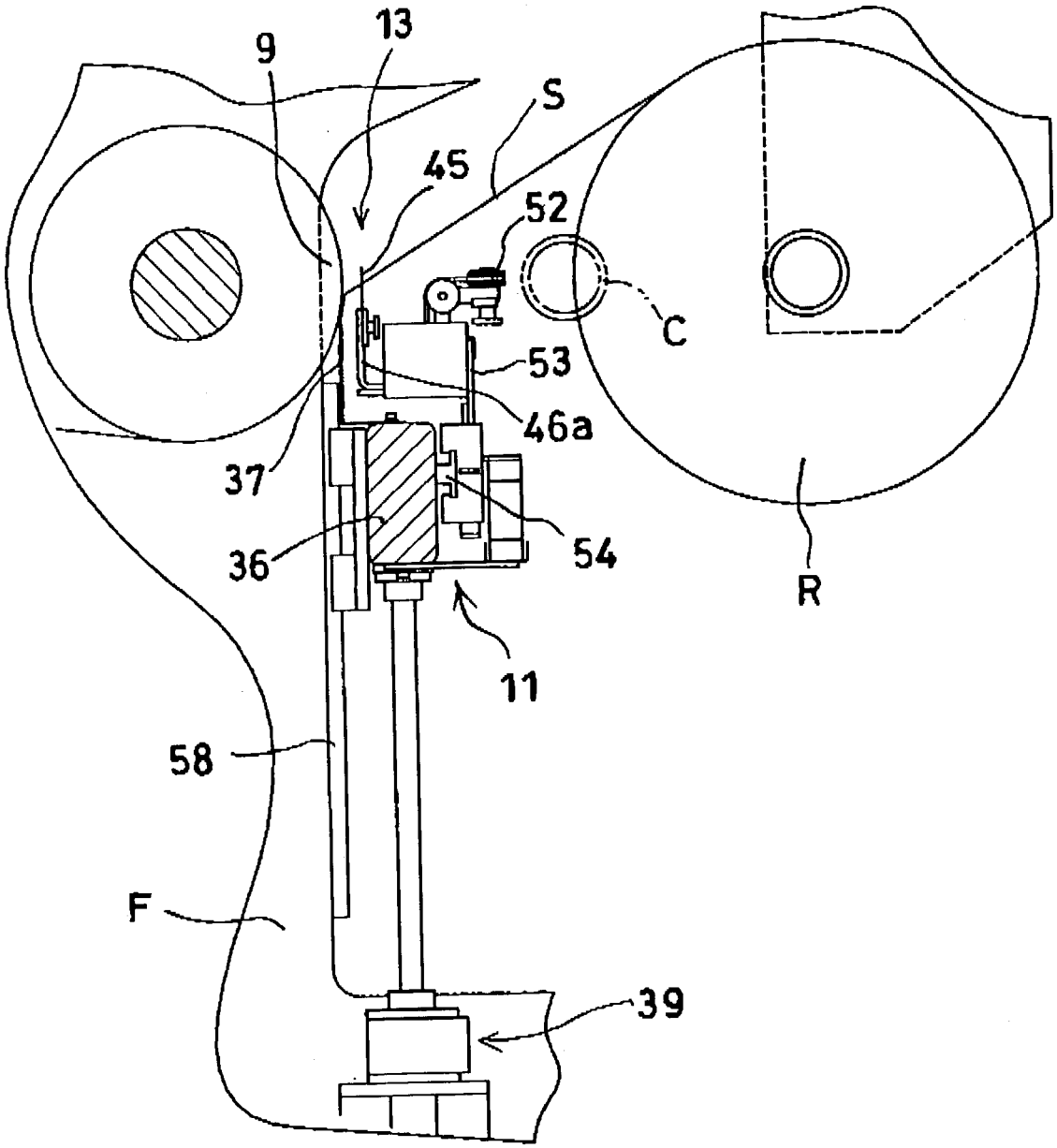
FIG. 26 is a side view of the rear apparatus of FIG. 23, showing a slit sheet being temporarily held by the temporary sheet holding mechanism.

The temporary sheet holding mechanism 11 shown in FIG. 26 has a holding bar 36 that is slidably mounted on a rail 58 attached to the frame F. The bar 36 is moved up or down on the rail 58 by a drive mechanism 39. When the bar 36 reaches the temporary sheet-holding position, the sheet-retaining plate 37 on the bar 36 can hold all the slit sheets against the touch roller.

The mechanism 11 has the same structure as the mechanism 10 and operates the same. The member that guides the adhesive applicator 53 of the mechanism 11 is provided on the holding bar 36 that carries the sheet-retaining plate 37. The cutting mechanism 13 includes a blade 45 attached to the adhesive applicator 53. When the pasting head 52 of the applicator 53 is opposite the portion of new cores C on which adhesive is to be applied, that is, at the position shown by the double-dot line in FIG. 26, the blade 45 is in position for cutting the slit sheets S.

As shown in FIG. 24, the core supply mechanism 14 includes a pair of trough-shaped holding arms 211 and 212, a pair of support guide mechanisms 213 attached to winding arms 5 and 6 that can be extended and retracted for guiding the lower ends of the arms 211 and 212 toward the central axis of the core chucks 7 and 8, and a pair of drives 214 for selectively moving the arms 211 and 212 to a core supply position at which a core C held at the lower end thereof is concentric with the core chucks 7 and 8, and to a position of retraction from a roll R wound on a core C mounted on the core chucks 7 and 8. The trough-shaped holding arms 211 and 212 are formed as mirror opposites, so have the same structure and operate the same.

Figure 27:
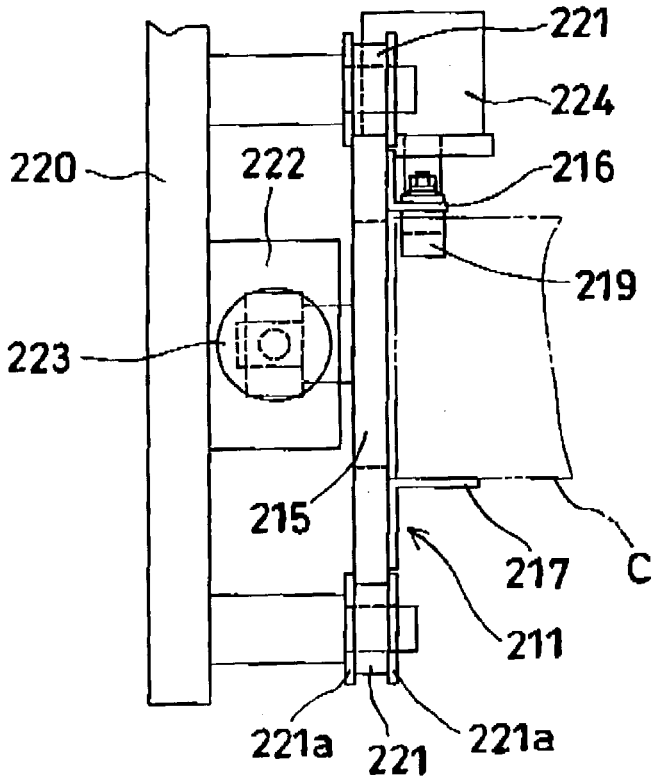
FIG. 27 is a plan view of the trough-shaped holding arms used in the apparatus of FIG. 24.
Figure 28:
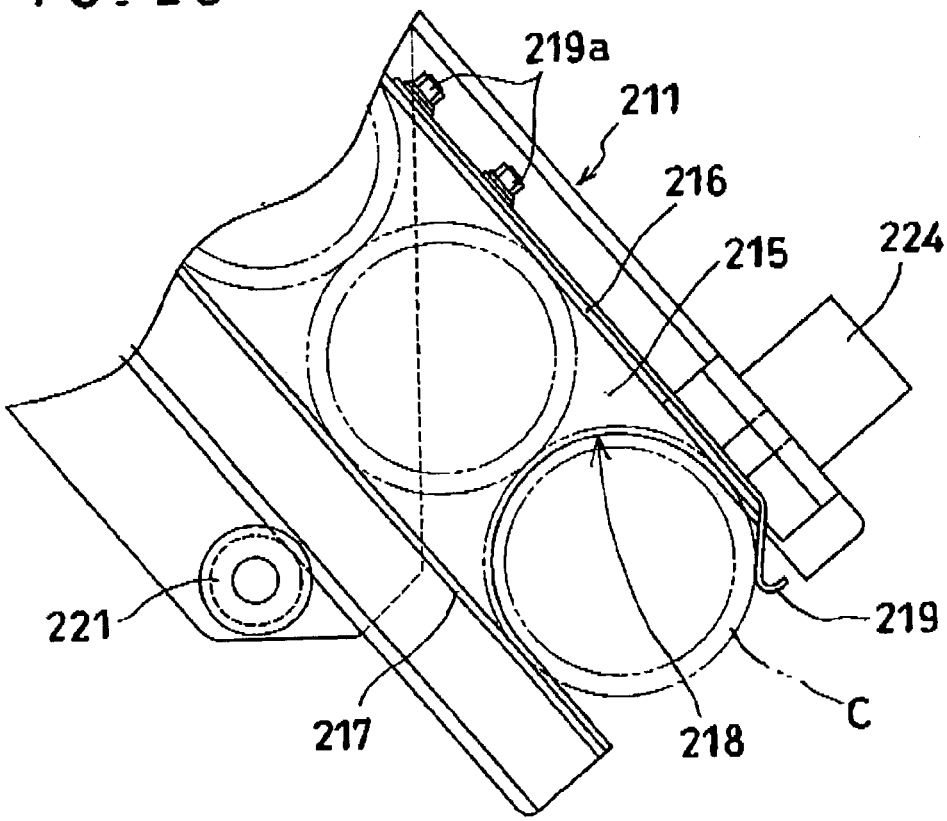
FIG. 28 is a partial side view of the lower part of the trough-shaped holding arms of FIG. 27.

As shown in FIG. 27 and FIG. 28, the trough-shaped holding arm 211 comprises front and rear walls 216 and 217 extending along the core length from opposing edges of a bottom portion 215 that faces an end face of new cores, a full-width cutout formed at the lower end of the bottom portion 215 for core chuck insertion and withdrawal, and a core-retaining stop 219 that prevents the lowermost core that is not held on a core chuck from falling from arm 211, and which can be retracted to allow the bottom core to be removed.

The core-retaining stop 219 is a plate spring, one end of which is affixed to the outer surface of the front wall 216 by a bolt 219*a*, and the other end of which projects from the front wall 216 into the core passage. The force imposed on the core-retaining stop 219 depends on the length of the cores and number of cores being held. If the retaining force of the core-retaining stop 219 is too small, it will not be able to prevent cores from falling. On the other hand, if the core-retaining stop 219 is too strong, cores mounted on the chucks cannot be extracted from the arm 211 without increasing the force generated by the drives 214 to retract the trough-shaped holding arms, which would mean using larger drives. To enable smaller drives to be used, each arm has a hydraulic pressure cylinder device 224 that drives a piston rod that urges the core-retaining stop 219 toward the front wall 216, thereby reducing the retaining force of the stop when cores are being removed from the arm 211. At other times, the piston rod is maintained in a retracted position. If required, the core-retaining stop 219 and hydraulic device 224 can be provided on the rear wall 217.

Figure 29:
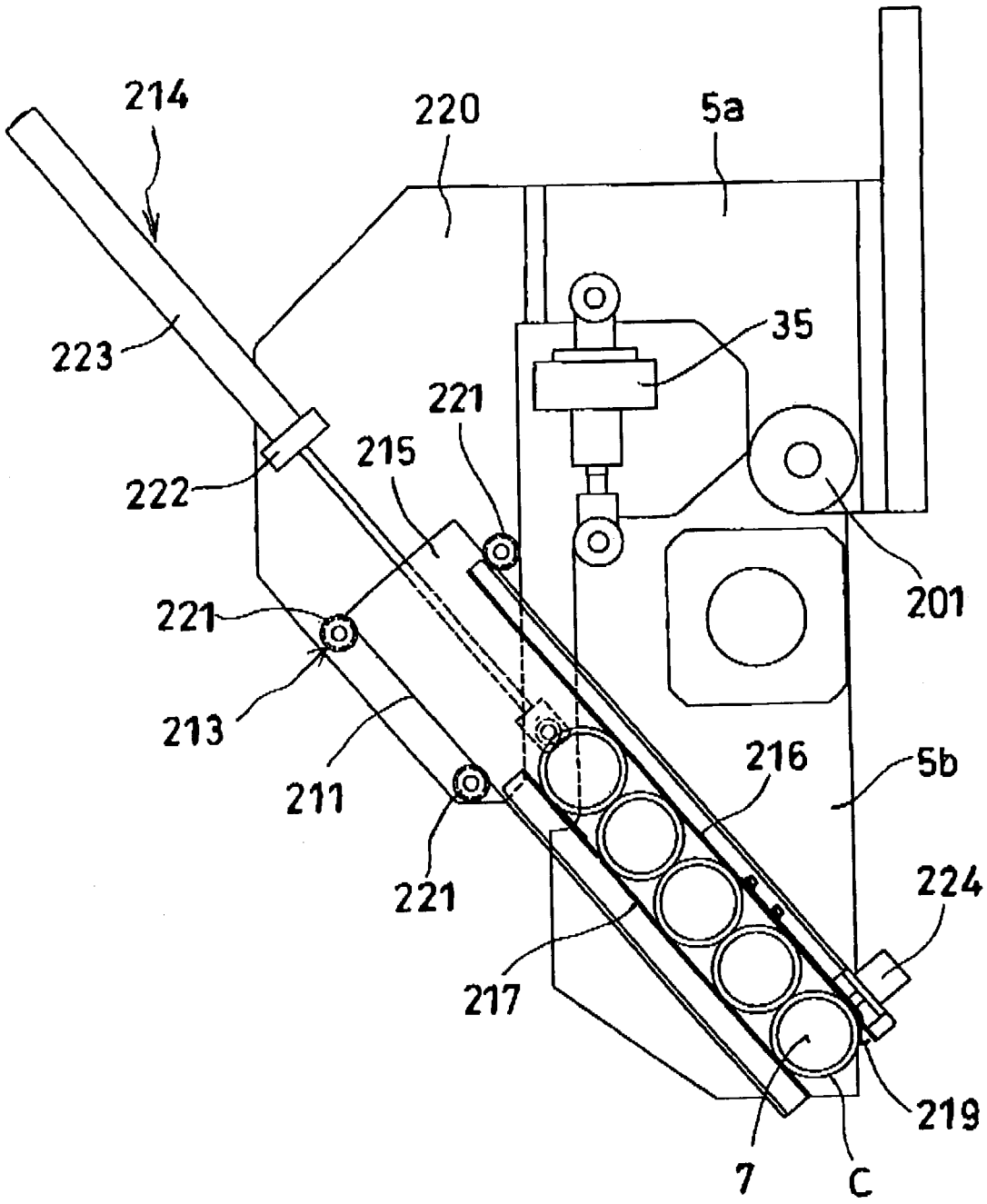
FIG. 29 is a side view showing the trough-shaped holding arms of FIG. 27 in the core supply position.

As shown in FIG. 29, support guide mechanism 213 comprises a plurality of guide wheels 221 rotatably provided on a bracket 220 affixed to the winding arm base 5*a*. Drive 214 is a hydraulic pressure cylinder device 223 attached to a fixing base 222 attached to the bracket 220. The end of the piston rod of the hydraulic device 223 is connected to the bottom portion 215 of the holding arm. As shown in FIG. 27, the guide wheels 221 have flanges 221*a* to prevent the arm 211 moving in the core length direction. The guide wheels 221 engage with the two edge portions of the bottom portion 215.

With respect to the core supply mechanism 14, the cores are loaded from the top into a pair of trough-shaped holding arms 211 and 212 in the retracted position. When finished rolls R are removed from between the core chucks 7 and 8 and taken out by the transporter 30, the holding arms 211 and 212 are moved into the delivery position and the core chucks 7 and 8 secure the bottom core, and the arms 211 and 212 are retracted. The core-retaining stop 219 is then retracted to release the mounted core.

As described in the foregoing, in accordance with the sheet slitter-winder of the invention, sheet can be cut by the cutting mechanism without damaging the cores. Also, the sheet on the upstream side of the cutter has an appropriate length that eliminates any need to re-cut it. Adhesive can be applied to an appropriate part of the new rolls or to an appropriate part of the slit sheet end held by the temporary sheet-holding means to enable the sheets to be adhered to the new rolls automatically. This eliminates the former need to apply adhesive to each of the cut slit-sheets and improves the yield. The slit sheets can be adhered to a plurality of new rolls at the same time, reducing the adhesion time and winding-down time. The sheet-retaining plate holds the ends of the slit sheets securely, whatever the thickness or stiffness of the sheet.

The adhesive application mechanism applies adhesive to a portion of a winding core mounted on the winder facing a touch roller to adhere the slit sheet. The applicator has a pasting head for applying adhesive to a core and adhesive for replenishing the pasting head, and is guided parallel to cores with the pasting head oriented at the portion of the cores that faces the touch rollers. The adhesive can be precisely applied, ensuring the correct amount, which ensures that thin sheet is not spoiled through wrinkling and the like caused by adhesion tension.

What is claimed is:

1. A sheet slitter-winder, comprising:

a sheet slitter that slits a wide sheet into a plurality of sheets of predetermined width;

first and second winders which wind the sheets slit by the slitter onto rotating winding cores to form rolls and between which winding of the slit sheets is alternated;

each of said first and second winders comprising a winding base, a pair of winding arms provided for a core and mounted on the winding base, a pair of core chucks provided for the pair of winding arms and touch rollers contacting each roll or a common touch roller contacting all rolls;

said winding arms being disposed at positions changeable in a lengthwise direction of each core;

said core chucks being detachably attachable to ends of each core to align the cores along a common center axis;

provisional sheet holding means provided for each of said first and second winders;

each of said provisional sheet holding means being movable toward and away from a bottom of a valley formed by each core and each touch roller or the common touch roller, including a holding bar that extends parallel to the wide sheet across a full width of the wide sheet and a sheet-retaining plate that is attached to the holding bar in a state sticking out toward the bottom of the valley, and enabling a front edge of the sheet-retaining plate to temporarily hold a slit sheet against an outside peripheral surface of a touch roller or the common touch roller at a point upstream of a point of contact between each touch roller or the common touch roller and each roll when bringing the holding bar to the valley during winding being stopped;

cutting means that can cut widthwise the slit sheet held against a touch roller by the front edge of the sheet-retaining plate downstream from the point of contact between the sheet-retaining plate and each touch roller or the common touch roller;

adhesive application mechanisms for applying adhesive for attaching to a portion of a fresh winding core retained at opposite ends by the core chucks, which portion faces the touch roller, a distal end of the slit sheet cut by the cutting means and retained relative to the touch roller by the sheet-retaining plate;

each of said adhesive application mechanisms comprising an adhesive applicator that includes a pasting head for applying the adhesive to a portion of a surface of the winding core that faces the touch roller, a container that contains adhesive for replenishing the pasting head and advancing and withdrawing means for advancing the pasting head to a position of contact with the winding core and withdrawing the pasting head to a retracted position, a guide that guides the adhesive applicator in an axial direction parallel to the winding core and a reciprocating drive that can move the adhesive applicator along the guide, said pasting head comprising an application roller that is enabled to roll on the surface of the winding core in a longitudinal direction of the winding core, a guide pulley that is positioned in the container to be steeped in the adhesive contained in the container and an endless belt that is mounted between the guide pulley and the application roller.

2. A sheet splitter-winder according to claim 1, further comprising a controller for operating the advancing and withdrawing means so that the pasting head advances to a forward position when the pasting head reaches positions at which application of the paste begins and, when the pasting head reaches positions at which application of the paste stops, the paste head is retracted to a retracted position from the forward position.

3. A sheet splitter-winder according to claim 1, wherein each of the adhesive application mechanisms applies the adhesive to the winding core, with opposite ends of the winding core left non-applied with the adhesive.

4. A sheet splitter-winder according to claim 2, wherein said controller comprises:

slit position memory means that stores positions at which the sheet is slit by the slitter;

memory means that stores lengths of portions from edges of the slit sheets to edges of the adhesive applied to the winding core in which the adhesive is not applied;

position calculation means that uses the slit positions and lengths of adhesive application and non-application stored in the slit position memory means;

means to calculate and store positions that mark the start of adhesive application on the slit sheets and positions at which adhesive application stops;

position sensing means that momentarily detects a current position of the pasting head of the adhesive applicator; and control signal generating means that compares the adhesive application start and stop positions from the position calculation means with detected values from the position sensing means and generates signals to control the advancing and withdrawing means to advance the pasting head from when the detected values from the position sensing means equal the calculated adhesive application start position to when they equal the application stop position.

5. A sheet splitter-winder according to claim 4, further comprising an automatic positioning controller for the slitter, wherein the slit position memory means receive data of the slit positions from the automatic positioning controller and stores the data.

6. A sheet splitter-winder according to claim 1, wherein each of the adhesive application mechanisms is provided with an engaging member of a specified length to rotate the application roller with the adhesive applicator at a specific position in a vicinity of a standby point.

7. A sheet splitter-winder according to claim 1, further comprising winding core supply means for the pair of winding arms that can supply the winding core between the pair of winding core chucks concentrically with a center line of the winding core chucks, wherein the winding core supply means comprises a pair of trough-shaped holding arms disposed inside the pair of winding arms, affixed to the pair of winding arms so that the trough-shaped holding arms can rotate about an axis parallel to the sheet width direction and retain opposite ends of a plurality of new winding cores arranged in parallel and a pair of rotation drive means attached to the pair of winding arms that can be set to a downward core supply position and a retraction position, in which each of the pair of winding arms comprises front and rear walls extending in a core length direction from opposite edges of a bottom portion facing ends of the new cores for guiding the new cores along the pair of trough-shaped holding arms in relation to ends of the new cores, a bottom wall that extends forward from a lower portion of the rear wall, a core outlet provided on a lower portion of the front wall, a full-width cutout formed at a lower end of the bottom portion that is used for core chuck insertion and withdrawal and a core retaining stop that prevents a lowermost core which is not held by the core chucks from falling from the core outlet by not allowing the lowermost core to advance to the outlet and which can hold the core chucks to be removed through the outlet.

8. A sheet splitter-winder according to claim 7, wherein said rotation drive means comprises a hydraulic pressure cylinder device.

9. A sheet-splitter-winder according to claim 7, wherein said core retaining stop comprises a plate spring having a rear end affixed to the lower wall and a front end projecting resiliently into an inside of the lower wall.

10. A sheet splitter-winder according to claim 1, further comprising winding core supply means for the pair of winding arms that can supply the winding cores between the pair of core chucks and comprises a pair of opposed trough-shaped holding arms that hold the cores in a row, support guide means attached to the winding arms that slidably support the pair of trough-shaped holding arms so that the trough-shaped holding arms can slide toward a center axis of the core chucks, with a lower edge of the trough-shaped holding arms guided by the support guide means, and advancing and retracting means that can selectively move the trough-shaped holding arms to a core supply position at which a core supported at a lower end of the trough-shaped holding arms is concentric with the core chucks and to a position of retraction from a wound roll formed on a core mounted on the core chucks and wherein the trough-shaped arms each comprise front and rear walls extending in a core lengthwise direction from opposing edges of a bottom portion facing ends of new cores, a full-width cutout formed at a lower end of the bottom portion that is used for core chuck insertion and withdrawal, and a core-retaining stop that prevents a lowermost core that is not held by a core chuck from falling from the core outlet by not allowing the core to advance to the outlet, and which can be retracted to thereby allow the lowermost core held by the core chuck to be removed through the outlet.

11. A sheet slitter-winder according to claim 1, wherein said cutting means includes a blade that is mounted on the adhesive applicator for cutting the slit sheets.

* * * * *